US011600232B2

(12) United States Patent
Hong et al.

(10) Patent No.: US 11,600,232 B2
(45) Date of Patent: Mar. 7, 2023

(54) DISPLAY DEVICE AND GATE DRIVING CIRCUIT HAVING A SYNCHRONIZATION TRANSISTOR

(71) Applicant: LG Display Co., Ltd., Seoul (KR)

(72) Inventors: Yewon Hong, Seoul (KR); Yeonwoo Shin, Gyeonggi-do (KR); TaeWoong Moon, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/550,818

(22) Filed: Dec. 14, 2021

(65) Prior Publication Data

US 2022/0199033 A1 Jun. 23, 2022

(30) Foreign Application Priority Data

Dec. 17, 2020 (KR) ..... 10-2020-0177895

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2300/0842* (2013.01); *G09G 2310/0278* (2013.01)

(58) Field of Classification Search
CPC ..... G09G 3/3266
USPC ..... 345/204
See application file for complete search history.

(56) References Cited

U.S. PATENT DOCUMENTS

| | | | | |
|---|---|---|---|---|
| 2016/0225311 | A1* | 8/2016 | Hwang | G09G 3/3208 |
| 2017/0092199 | A1* | 3/2017 | Park | G09G 3/3258 |
| 2018/0190205 | A1* | 7/2018 | Choi | G09G 3/3266 |
| 2020/0184896 | A1* | 6/2020 | Lee | G09G 3/3241 |

* cited by examiner

*Primary Examiner* — Long D Pham
(74) *Attorney, Agent, or Firm* — Seed IP Law Group LLP

(57) ABSTRACT

One or more embodiments of the present disclosure relate to a display device and a gate driving circuit. There is further provided with a synchronization transistor controlled according to a voltage of a Q node of a m-th scan driver (e.g., a second scan driver) and controlling an electrical connection between an output terminal of the n-th light emitting driver and a clock input terminal of the m-th scan driver, so that the rising characteristic and/or the falling characteristic of the light emission signal which is a type of the gate signal can be improved, thereby improving a threshold voltage compensation performance of the driving transistor and the image quality.

20 Claims, 26 Drawing Sheets

DISPLAY DEVICE AND GATE DRIVING CIRCUIT HAVING A SYNCHRONIZATION TRANSISTOR

CROSS REFERENCE TO RELATED APPLICATION

This application claims priority from Korean Patent Application No. 10-2020-0177895, filed on Dec. 17, 2020, which is hereby incorporated by reference for all purposes as if fully set forth herein.

TECHNICAL FIELD

The present disclosure relates to a display device and a gate driving circuit.

BACKGROUND

The growth of the information society leads to increased demand for various types of display devices, and in recent years, development of a self-luminous display in which a display panel directly emits light is being actively developed.

In the case of a conventional self-luminous display, each of a plurality of subpixels arranged in a display panel includes a light emitting device and a driving transistor for driving the light emitting device, and a light emitting transistor for controlling whether the light emitting device emits light or timing of light emission and the like.

As the driving time of each subpixel increases, there may occur the deterioration of the driving transistor, and in the case of the deterioration of the driving transistor, the threshold voltage or mobility of the driving transistor may be changed. Depending on the driving time deviation of each of the plurality of subpixels, the degree of deterioration of the driving transistors in the plurality of subpixels may be different, and there may occur a deviation in characteristics between the driving transistors in the plurality of subpixels. For this reason, a luminance deviation of a plurality of subpixels may occur, which may lead to deterioration of image quality.

Accordingly, in general, there has been developed a technology for compensating for deviation in characteristic values by sensing characteristic values of driving transistors. However, despite such compensation, there are still problems such as a luminance deviation between subpixels.

SUMMARY

The present applicant found that the reason why the image quality is deteriorated despite compensation of the characteristic value of the driving transistor is due to the deterioration or deviation of the on-off performance of the light emitting transistor controlling the emission of the light emitting device or the light emission timing.

Accordingly, embodiments of the present disclosure may provide a display device and a gate driving circuit capable of accurately performing an internal compensation and improving the image quality without being affected by deterioration or deviation of the on-off performance of the light emitting transistor for controlling the emission of the light emitting device or the light emission timing.

Embodiments of the present disclosure may provide a display device and a gate driving circuit capable of improving the rising characteristic and/or the falling characteristic of a light emission signal which is a type of a gate signal, thereby improving the threshold voltage compensation performance of the driving transistor to improve the image quality.

Embodiments of the present disclosure may provide a display device and a gate driving circuit capable of improving the rising characteristic and/or the falling characteristic of a light emission signal which is a type of a gate signal, thereby increasing the data input time and improving the charging performance of the subpixel to improve the image quality.

In one aspect, embodiments of the present disclosure may provide a display device including ca display panel including a plurality of data lines, a plurality of first scan lines, a plurality of second scan lines, a plurality of light emission lines and a plurality of subpixels, a data driving circuit for outputting data voltages to the plurality of data lines, and a gate driving circuit for outputting first scan signals to the plurality of first scan lines, outputting second scan signals to the plurality of second scan lines, and outputting light emission signals to the plurality of light emission lines.

The plurality of subpixels may constitute a plurality of subpixel rows, and the plurality of subpixel rows may include a n-th subpixel row.

The plurality of first scan lines may include a n-th first scan line corresponding to the n-th subpixel row and a m-th first scan line corresponding to a m-th subpixel row which is identical to or different from the n-th subpixel row, and the plurality of second scan lines may include a n-th second scan line corresponding to the n-th subpixel row and a m-th second scan line corresponding to the m-th subpixel row, and the plurality of the light emission lines may include a n-th light emission line corresponding to the n-th subpixel row and n m-th light emission line corresponding to the m-th subpixel row.

The gate driving circuit may include a n-th gate driving circuit including a n-th first scan driver for outputting a n-th first scan signal to the n-th first scan line, and a n-th second scan driver for outputting a n-th second scan signal to the n-th second scan line, and a n-th light emitting driver for outputting a n-th light emission signal to the n-th light emission line, a m-th gate driving circuit including a m-th first scan driver for outputting a m-th first scan signal to the m-th first scan line, a m-th second scan driver for outputting a m-th second scan signal to the m-th second scan line, and a m-th light emitting driver for outputting a m-th light emission signal to the m-th light emission line.

The display device may further include a synchronization transistor controlled based on a voltage of a Q node of the m-th second scan driver and controlling an electrical connection between an output terminal of the n-th light emitting driver and a clock input terminal of the m-th second scan driver.

During a period in which a n-th subpixel included in the n-th subpixel row is driven, the n-th light emission signal may include a first turn-off level voltage section, a first turn-on level voltage section, a second turn-off level voltage section and a second turn-on level voltage section.

A rising timing or a falling timing at which the first turn-off level voltage section is changed to the first turn-on level voltage section may be synchronized with a rising timing or a falling timing of the m-th second scan signal.

The n-th light emitting driver may include a pull-up transistor and a pull-down transistor, and the m-th second scan driver may include a pull-up transistor and a pull-down transistor.

In the case that a type of each of the pull-up transistor and the pull-down transistor included in the n-th light emitting driver is the same as a type of each of the pull-up transistor and pull-down transistor included in the m-th second scan driver, during a period in which the n-th subpixel included in the n-th subpixel row is driven, in the n-th light emission signal, a falling timing or a rising timing at which the first turn-on level voltage section is changed to the second turn-off level voltage section may be synchronized with a falling timing or a rising timing of the m-th second scan signal.

In the case that a type of each of the pull-up transistor and the pull-down transistor included in the n-th light emitting driver is different from a type of each of the pull-up transistor and pull-down transistor included in the m-th second scan driver, during a period in which the n-th subpixel included in the n-th subpixel row is driven, in the n-th light emission signal, a falling timing or a rising timing at which the first turn-on level voltage section is changed to the second turn-off level voltage section may be not synchronized with a falling timing or a rising timing of the m-th second scan signal.

The n-th subpixel included in the n-th subpixel row may include a light emitting device, a driving transistor for driving the light emitting device, a first scan transistor controlled by the n-th first scan signal and configured to control an electrical connection between a first node of the driving transistor and a data line, a second scan transistor controlled by the n-th second scan signal and configured to control an electrical connection between a second node of the driving transistor and an initialization line, a light emitting transistor controlled by the n-th light emission signal and configured to control an electrical connection between a third node of the driving transistor and a driving line, and a storage capacitor connected between the first node and the second node of the driving transistor. Here, during a period in which the n-th subpixel included in the n-th subpixel row is driven, the n-th light emission signal includes a first turn-off level voltage section, a first turn-on level voltage section, a second turn-off level voltage section and a second turn-on level voltage section, and, in the n-th light emission signal, a rising timing or a falling timing at which the first turn-off level voltage section is changed to the first turn-on level voltage section may be synchronized with a rising timing or a falling timing of the m-th second scan signal.

The type of the synchronization transistor may be the same as a type of each of the first scan transistor and the second scan transistor.

The n-th light emitting driver may include a pull-up transistor and a pull-down transistor, and the m-th second scan driver may include a pull-up transistor and a pull-down transistor. In this case, a type of the synchronization transistor may be the same as a type of each of the pull-up transistor and the pull-down transistor included in the m-th second scan driver.

The first scan transistor, the second scan transistor and the light emitting transistor may be N-type transistors.

In the case that the first scan transistor, the second scan transistor and the light emitting transistor are N-type transistors, the n-th light emitting driver may include a pull-up transistor and a pull-down transistor which are N-type transistors, and the m-th second scan driver may include a pull-up transistor and a pull-down transistor which are N-type transistors. The synchronization transistor may be an N-type transistor.

In the case that the first scan transistor, the second scan transistor and the light emitting transistor are N-type transistors, the m is (n+1), and, during the period in which the n-th subpixel included in the n-th subpixel row is driven, in the n-th light emission signal, a rising timing at which the first low-level voltage section is changed to the first high-level voltage section may be synchronized with a rising timing of a (n+1)-th second scan signal. In addition, in the n-th light emission signal, a falling timing at which the first high-level voltage section is changed to the second low-level voltage section may be synchronized with a falling timing of the (n+1)-th second scan signal.

The first scan transistor, the second scan transistor and the light emitting transistor may be P-type transistors.

In the case that the first scan transistor, the second scan transistor and the light emitting transistor are P-type transistors, the n-th light emitting driver may include a pull-up transistor and a pull-down transistor which are P-type transistors, and the m-th second scan driver may include a pull-up transistor and a pull-down transistor which are P-type transistors, and the synchronization transistor may be a P-type transistor.

In the case that the first scan transistor, the second scan transistor and the light emitting transistor are P-type transistors, the m is (n+1), and, during the period in which the n-th subpixel included in the n-th subpixel row is driven, in the n-th light emission signal, a falling timing at which the first high-level voltage section is changed to the first low-level voltage section may be synchronized with a falling timing of a (n+1)-th second scan signal. In addition, in the n-th light emission signal, a rising timing at which the first low-level voltage section is changed to the second high-level voltage section may be synchronized with a rising timing of the (n+1)-th second scan signal.

The first scan transistor and the second scan transistor may be N-type transistors, and the light emitting transistor may be a P-type transistor.

In the case that the first scan transistor and the second scan transistor are N-type transistors and the light emitting transistor is a P-type transistor, the n-th light emitting driver may include a pull-up transistor and a pull-down transistor which are P-type transistors, and the m-th second scan driver may include a pull-up transistor and a pull-down transistor which are N-type transistors, and the synchronization transistor may be a N-type transistor.

In the case that the first scan transistor and the second scan transistor are N-type transistors and the light emitting transistor is a P-type transistor, the m is the n, and, during the period in which the n-th subpixel included in the n-th subpixel row is driven, in the n-th light emission signal, a falling timing at which the first high-level voltage section is changed to the first low-level voltage section may be synchronized with a falling timing of the n-th second scan signal. In the n-th light emission signal, a rising timing at which the first low-level voltage section is changed to the second high-level voltage section may be not synchronized with a rising timing of the n-th second scan signal.

The first scan transistor and the second scan transistor may be P-type transistors and the light emitting transistor may be a N-type transistor.

In the case that the first scan transistor and the second scan transistor are P-type transistors and the light emitting transistor is a N-type transistor, the n-th light emitting driver may include a pull-up transistor and a pull-down transistor which are N-type transistors, and the m-th second scan driver may include a pull-up transistor and a pull-down transistor which are P-type transistors, and the synchronization transistor may be a P-type transistor.

In the case that the first scan transistor and the second scan transistor are P-type transistors and the light emitting transistor is a N-type transistor, the m is the n, and, during the period in which the n-th subpixel included in the n-th subpixel row is driven, in the n-th light emission signal, a rising timing at which the first low-level voltage section is changed to the first high-level voltage section may be synchronized with a rising timing of the n-th second scan signal. In the n-th light emission signal, a falling timing at which the first high-level voltage section is changed to the second low-level voltage section may be not synchronized with a falling timing of the n-th second scan signal.

During a period in which the n-th light emission signal is the first turn-on level voltage section within the period in which the n-th subpixel included in the n-th subpixel row is driven, a voltage of the second node of the driving transistor may be boosted, and a voltage difference between the first node and the second node of the driving transistor may become a threshold voltage of the driving transistor.

Embodiments of the present disclosure may provide a display device including a display panel including a plurality of data lines, a plurality of first scan lines, a plurality of second scan lines, a plurality of light emission lines, and a plurality of subpixels, a data driving circuit for outputting data voltages to the plurality of data lines, and a gate driving circuit for outputting first scan signals to the plurality of first scan lines, outputting second scan signals to the plurality of second scan lines, and outputting light emission signals to the plurality of light emission lines.

Each of the plurality of subpixels may include a light emitting device, a driving transistor for driving the light emitting device, a first scan transistor controlled by a first scan signal and configured to control an electrical connection between a first node of the driving transistor and a data line, a second scan transistor controlled by a second scan signal and configured to control an electrical connection between a second node of the driving transistor and an initialization line, a light emitting transistor controlled by the light emission signal and configured to control an electrical connection between a third node of the driving transistor and a driving line, and a storage capacitor connected between the first node and the second node of the driving transistor.

The plurality of subpixels may constitute a plurality of subpixel rows, and the plurality of subpixel rows may include a n-th subpixel row.

The plurality of first scan lines may include a n-th first scan line corresponding to the n-th subpixel row and a m-th first scan line corresponding to a m-th subpixel row which is identical to or different from the n-th subpixel row, and the plurality of second scan lines may include a n-th second scan line corresponding to the n-th subpixel row and a m-th second scan line corresponding to the m-th subpixel row, and the plurality of the light emission lines may include a n-th light emission line corresponding to the n-th subpixel row and n m-th light emission line corresponding to the m-th subpixel row.

During a period in which a n-th subpixel included in the n-th subpixel row is driven, a n-th light emission signal may include a first turn-off level voltage section, a first turn-on level voltage section, a second turn-off level voltage section and a second turn-on level voltage section.

During a period in which a n-th subpixel included in the n-th subpixel row is driven, in the n-th light emission signal, a rising timing or a falling timing at which the first turn-off level voltage section is changed to the first turn-on level voltage section may be synchronized with a rising timing or a falling timing of a m-th second scan signal.

The gate driving circuit may include a n-th gate driving circuit including a n-th first scan driver for outputting a n-th first scan signal to the n-th first scan line, and a n-th second scan driver for outputting a n-th second scan signal to the n-th second scan line, and a n-th light emitting driver for outputting a n-th light emission signal to the n-th light emission line, a m-th gate driving circuit including a m-th first scan driver for outputting a m-th first scan signal to the m-th first scan line, a m-th second scan driver for outputting a m-th second scan signal to the m-th second scan line, and a m-th light emitting driver for outputting a m-th light emission signal to the m-th light emission line.

The display device may further include a synchronization transistor controlled based on a voltage of a Q node of the m-th second scan driver and controlling an electrical connection between an output terminal of the n-th light emitting driver and a clock input terminal of the m-th second scan driver.

The type of the synchronization transistor may be the same as a type of each of the first scan transistor and the second scan transistor.

Embodiments of the present disclosure may provide a gate driving circuit including a n-th light emitting driver for outputting a n-th light emission signal to a n-th light emission line corresponding to a n-th subpixel row, a m-th scan driver (second scan driver) a for outputting a m-th scan signal to a m-th scan line corresponding to a m-th subpixel row which is the same as or different from the n-th subpixel row, and a synchronization transistor controlled based on a voltage of a Q node of the m-th scan driver (a second scan driver) and controlling an electrical connection between an output terminal of the n-th light emitting driver and a clock input terminal of the m-th scan driver.

According to embodiments of the present disclosure, it is possible to provide a display device and a gate driving circuit capable of accurately performing an internal compensation and improving the image quality without being affected by deterioration or deviation of the on-off performance of the light emitting transistor for controlling the emission of the light emitting device or the light emission timing.

According to embodiments of the present disclosure, it is possible to provide a display device and a gate driving circuit capable of improving the rising characteristic and/or the falling characteristic of a light emission signal which is a type of a gate signal, thereby improving the threshold voltage compensation performance of the driving transistor to improve the image quality.

According to embodiments of the present disclosure, it is possible to provide a display device and a gate driving circuit capable of improving the rising characteristic and/or the falling characteristic of a light emission signal which is a type of a gate signal, thereby increasing the data input time and improving the charging performance of the subpixel to improve the image quality.

DETAILED DESCRIPTION

Figure 1:
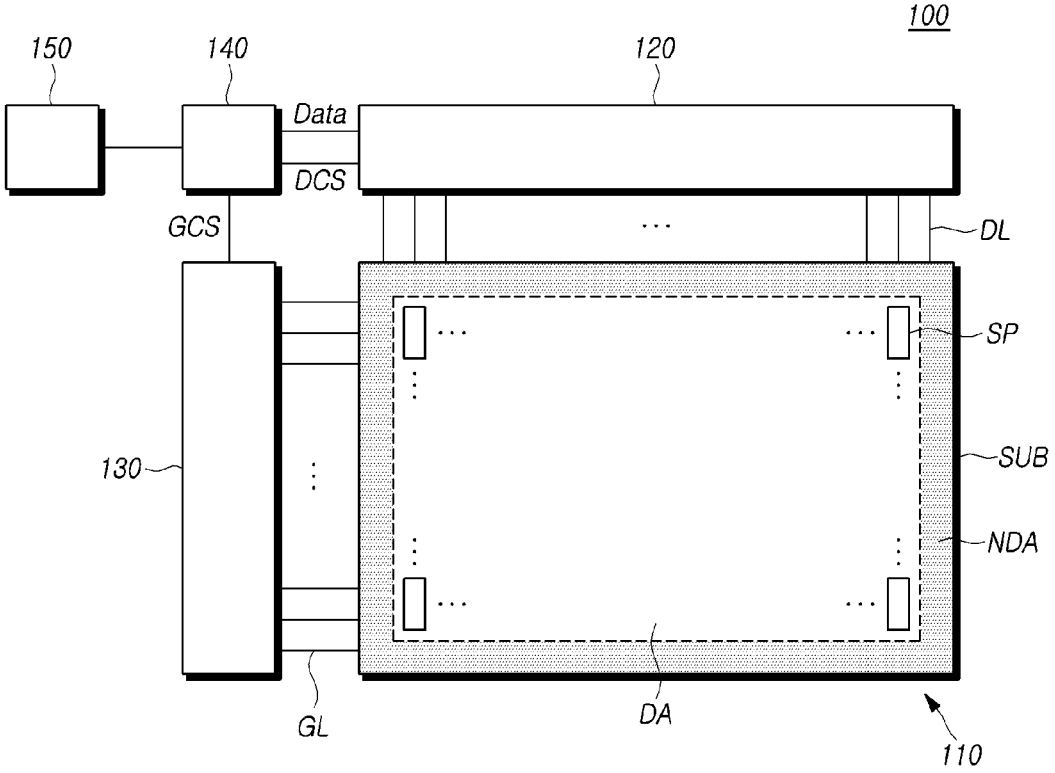
FIG. 1 illustrates a system configuration of a display device according to embodiments of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including", "having," "containing," "constituting" "make up of," and "formed of" used herein are generally intended to allow other components to be added unless the terms are used with the term "only." As used herein, singular forms are intended to include plural forms unless the context clearly indicates otherwise.

Terms, such as "first," "second," "A," "B," "(A)," or "(B)" may be used herein to describe elements of the present disclosure. Each of these terms is not used to define essence, order, sequence, or number of elements, etc., but is used merely to distinguish the corresponding element from other elements.

When it is mentioned that a first element "is connected or coupled to," "contacts or overlaps," etc., a second element, it should be interpreted that, not only can the first element "be directly connected or coupled to" or "directly contact or overlap" the second element, but a third element can also be "interposed" between the first and second elements, or the first and second elements can "be connected or coupled to," "contact or overlap," etc., each other via a fourth element. Here, the second element may be included in at least one of two or more elements that "are connected or coupled to," "contact or overlap," etc., each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes, etc., are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 illustrates a system configuration included in a display device 100 according to embodiments of the present disclosure.

Referring to FIG. 1, the display device 100 may include a display panel 110 and a driving circuit for driving the display panel 110.

The driving circuit may include a data driving circuit 120 and a gate driving circuit 130, and may further include a controller 140 for controlling the data driving circuit 120 and the gate driving circuit 130.

The display panel 110 may include a substrate SUB and signal lines such as a plurality of data lines DL and a plurality of gate lines GL disposed on the substrate SUB. The display panel 110 may include a plurality of subpixels SP connected to a plurality of data lines DL and a plurality of gate lines GL.

The plurality of gate lines GL may include a plurality of first scan lines SCL1, a plurality of second scan lines SCL2, and a plurality of light emission lines EML.

The plurality of subpixels SP disposed on the display panel 110 may constitute a plurality of subpixel rows. Each of the plurality of subpixel rows may be connected to one first scan line SCL1, one second scan line SCL2 and one light emission line EML.

The display panel 110 may include a display area DA in which an image is displayed and a non-display area NDA in which an image is not displayed. In the display panel 110, a plurality of subpixels SP for displaying an image may be disposed in the display area DA. In the non-display area NDA, the driving circuits 120, 130, and 140 may be electrically connected or mounted, and a pad unit to which an integrated circuit or a printed circuit is connected may be disposed.

The data driving circuit 120 is a circuit for driving the plurality of data lines DL, and may output data voltages to the plurality of data lines DL.

The gate driving circuit 130 is a circuit for driving the plurality of gate lines GL, and may supply gate signals to the plurality of gate lines GL.

The plurality of gate lines GL may include a plurality of first scan lines SCL1, a plurality of second scan lines SCL2, and a plurality of light emission lines EML.

Accordingly, the gate driving circuit 130 may output first scan signals to the plurality of first scan lines SCL1, and may output second scan signals to the plurality of second scan lines SCL2, and may output light emission signals to the light emission line EML. Accordingly, the gate driving circuit 130 may include first scan drivers for outputting the first scan signals to the plurality of first scan lines SCL1, second scan drivers for outputting the second scan signals to the plurality of second scan lines SCL2, and light emitting drivers for outputting the light emission signals to the plurality of light emission lines EML.

The controller 140 may supply the data driving timing control signal DCS to the data driving circuit 120 to control the operation timing of the data driving circuit 120. The controller 140 may supply the gate driving timing control signal GCS for controlling the operation timing of the gate driving circuit 130 to the gate driving circuit 130.

The controller 140 may start scanning according to the timing implemented in each frame, and may convert the input image data input from the outside according to the data voltage format used by the data driving circuit 120 to supply the converted image data to the data driving circuit 120 and to control the data driving at an appropriate time according to the scan.

The controller 140 may receive, in addition to the input image data, various timing signals including a vertical synchronization signal VSYNC, a horizontal synchronization signal HSYNC, an input data enable signal DE, a clock signal CLK from the outside (e.g., host system 150).

The controller 140 may generate various control signals DCS and GCS by using various timing signals such as the vertical synchronization signal VSYNC, the horizontal synchronization signal HSYNC, the input data enable signal DE and the clock signal CLK received from the outside, and may output the control signals to the data driving circuit 120 and the gate driving circuit 130.

For example, in order to control the gate driving circuit 130, the controller 140 may output various gate control signals GCS including a gate start pulse GSP, a gate shift clock GSC, and a gate output enable signal GOE.

In addition, in order to control the data driving circuit 120, the controller 140 may output various data control signals DCS including a source start pulse SSP, a source sampling clock SSC, a source output enable signal SOE, or the like.

The controller 140 may be implemented as a separate component from the data driving circuit 120, or may be integrated with the data driving circuit 120 and implemented as an integrated circuit.

The data driving circuit 120 may drive the plurality of data lines DL by receiving image data from the controller 140 and supplying data voltages to the plurality of data lines DL. Here, the data driving circuit 120 may be also referred to as a source driving circuit.

The data driving circuit 120 may include one or more source driver integrated circuits SDIC.

Each source driver integrated circuit SDIC may include a shift register, a latch circuit, a digital-to-analog converter, an output buffer, and the like. Each source driver integrated circuit SDIC may further include an analog-to-digital converter ADC, in some cases.

For example, each source driver integrated circuit SDIC may be connected to the display panel 110 by a tape automated bonding (TAB) method, or may be connected to a bonding pad of the display panel 110 in a method of a chip-on-glass (COG) or a chip-on-panel (COP), or may be implemented in a chip-on-film (COF) method to be connected to the display panel 110.

The gate driving circuit 130 may output a gate signal of a turn-on level voltage or a gate signal of a turn-off level voltage according to the control of the controller 140. The gate driving circuit 130 may sequentially drive the plurality of gate lines GL by sequentially supplying a gate signal having a turn-on level voltage to the plurality of gate lines GL.

The gate driving circuit 130 may be connected to the display panel 110 by a tape automated bonding (TAB) method, or may be connected to a bonding pad of the display panel 110 by a chip-on-glass (COG) or chip-on-panel (COP) method, or may be connected to the display panel 110 according to a chip-on-film (COF) method. Alternatively, the gate driving circuit 130 may be formed in the non-display area NDA of the display panel 110 in a gate-in-panel (GIP) type. The gate driving circuit 130 may be disposed on or connected to the substrate SUB. That is, in the case of the GIP type, the gate driving circuit 130 may be disposed in the non-display area NDA of the substrate SUB. The gate driving circuit 130 may be connected to the substrate SUB in the case of a chip-on-glass (COG) type, a chip-on-film (COF) type, or the like.

When a specific gate line GL is opened by the gate driving circuit 130, the data driving circuit 120 may convert the image data received from the controller 140 into an analog data voltage and supply to the data line DL.

The data driving circuit 120 may be connected to one side (e.g., upper or lower side) of the display panel 110. Depending on the driving method, the panel design method, etc., the data driving circuit 120 may be connected to both sides (e.g., upper and lower sides) of the display panel 110 or may be connected to at least two of the four sides of the display panel 110.

The gate driving circuit 130 may be connected to one side (e.g., left or right) of the display panel 110. Depending on the driving method, the panel design method, etc., the gate driving circuit 130 may be connected to both sides (e.g., left and right) of the display panel 110 or may be connected to at least two of the four sides of the display panel 110.

The controller 140 may be a timing controller used in a general display technology or a control device capable of further performing other control functions including a timing controller. Alternatively, the controller may be a control device different from the timing controller, or may be a circuit within the control device. The controller 140 may be implemented with various circuits or electronic components, such as an integrated circuit (IC), a field programmable gate array (FPGA), an application specific integrated circuit (ASIC), or a processor.

The controller 140 may be mounted on a printed circuit board or a flexible printed circuit, etc., and may be electrically connected to the data driving circuit 120 and the gate driving circuit 130 through the printed circuit board or the flexible printed circuit, etc.

The controller 140 may transmit or receive signals to and from the data driving circuit 120 according to one or more predetermined interfaces. Here, for example, the interface may include a low voltage differential signaling (LVDS) interface, an EPI interface, and a serial peripheral interface (SPI).

The controller 140 may include a storage medium such as one or more registers.

The display device 100 according to the embodiments of the present disclosure may be a self-luminous display such as an organic light emitting diode (OLED) display, a quantum dot display, and a micro light emitting diode display, etc.

In the case that the display device 100 according to embodiments of the present disclosure is an OLED display, each subpixel SP may include an organic light emitting diode (OLED) for emitting light as a light emitting device. If the display device 100 according to embodiments of the present disclosure is a quantum dot display, each subpixel SP may include a light emitting device made of quantum dots which are self-luminous semiconductor crystals. If the display device 100 according to the embodiments of the present disclosure is a micro LED display, each subpixel SP may include micro light emitting devices made of self-luminous inorganic material as a light emitting device.

Figure 2:
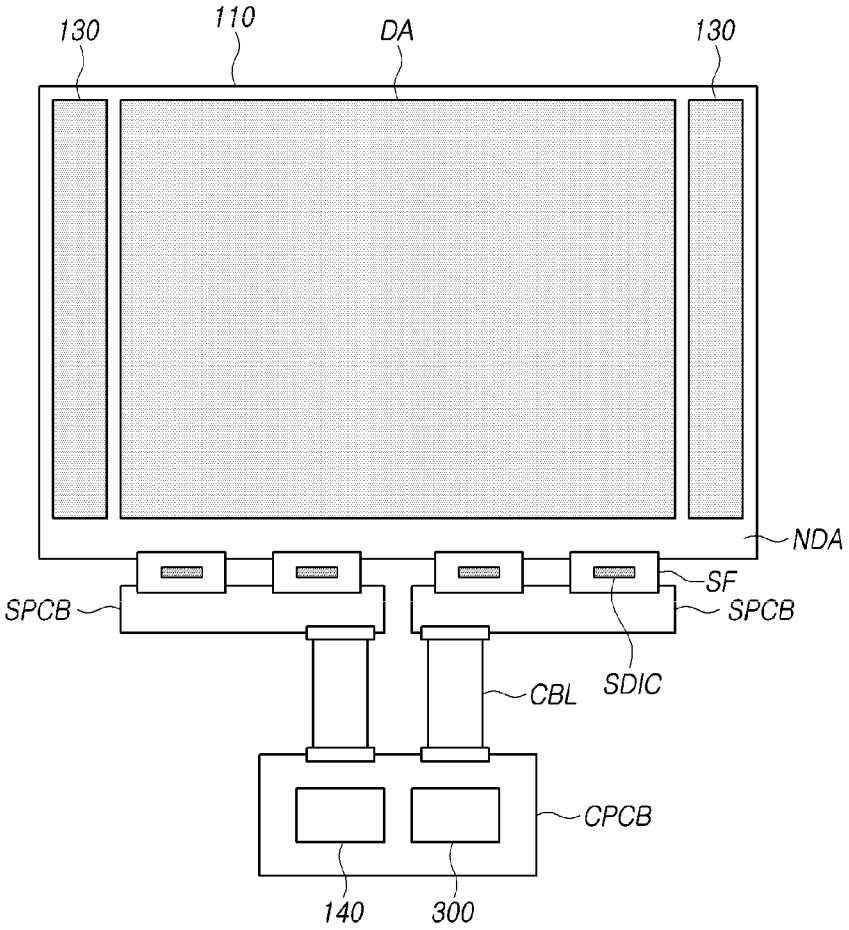
FIG. 2 illustrates an example of a system implementation of a display device according to embodiments of the present disclosure.

FIG. 2 illustrates an example of a system implementation of a display device 100 according to embodiments of the present disclosure.

Referring to FIG. 2, the display panel 110 may include a display area DA in which an image is displayed and a non-display area NDA in which an image is not displayed.

Referring to FIG. 2, in the case that the data driving circuit 120 includes one or more source driver integrated circuits SDIC and is implemented in a chip-on-film (COF) method, each source driver integrated circuit SDIC may be mounted on the circuit film SF connected to the non-display area NDA of the panel 110.

Referring to FIG. 2, the gate driving circuit 130 may be implemented as a gate-in-panel (GIP) type. In this case, the gate driving circuit 130 may be formed in the non-display area NDA of the display panel 110. In other embodiments, unlike FIG. 2, the gate driving circuit 130 may be implemented as a chip-on-film (COF) type.

The display device 100 may include, for circuit connection between one or more source driver integrated circuits SDICs and other devices, at least one source printed circuit board SPCB and a control printed circuit board CPCB for mounting control components and various electrical devices.

The circuit film SF on which the source driver integrated circuit SDIC is mounted may be connected to at least one source printed circuit board SPCB. That is, one side of the circuit film SF mounting the source driver integrated circuit SDIC may be electrically connected to the display panel 110 and the other side thereof may be electrically connected to the source printed circuit board SPCB.

The controller 140 and a power management integrated circuit PMIC 300 may be mounted on the control printed circuit board CPCB. The controller 140 may perform overall control functions related to driving of the display panel 110, and may control operations of the data driving circuit 120 and the gate driving circuit 130. The power management integrated circuit 300 may supply various voltages or currents to the data driving circuit 120 and the gate driving circuit 130, or may control voltages or currents to be supplied.

At least one source printed circuit board SPCB and the control printed circuit board CPCB may be electrically connected through at least one connection cable CBL. Here, the connection cable CBL may be, for example, a flexible printed circuit (FPC), a flexible flat cable (FFC), or the like.

At least one source printed circuit board SPCB and control printed circuit board CPCB may be implemented by being integrated into one printed circuit board.

The display device 100 according to some embodiments of the present disclosure may further include a level shifter for adjusting a voltage level. For example, the level shifter may be disposed on the control printed circuit board CPCB or the source printed circuit board SPCB. In the display device 100 according to embodiments of the present disclosure, the level shifter may supply signals for gate driving to the gate driving circuit 130. For example, the level shifter may supply a plurality of clock signals to the gate driving circuit 130. Accordingly, the gate driving circuit 130 may output the plurality of gate signals to the plurality of gate lines GL based on the plurality of clock signals input from the level shifter. Here, the plurality of gate lines GL may transmit a plurality of gate signals to the subpixels SP disposed in the display area DA of the substrate SUB.

Figure 3A:
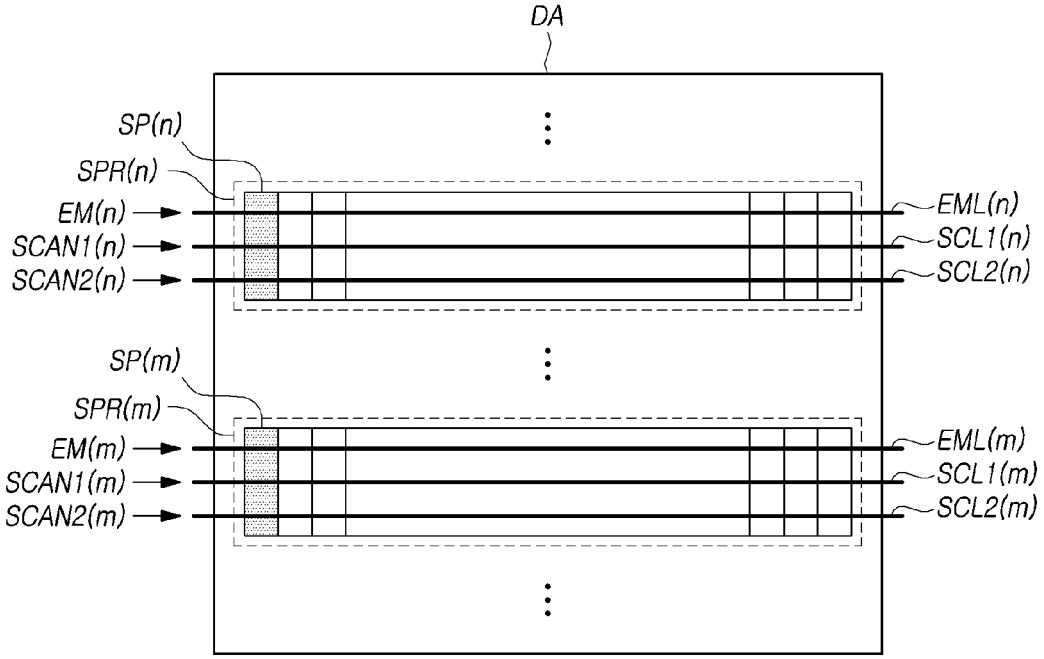
FIG. 3A illustrates subpixel rows in a display panel according to embodiments of the present disclosure.

FIG. 3A illustrates subpixel rows in a display panel 110 according to embodiments of the present disclosure.

Referring to FIG. 3A, the plurality of subpixels SP disposed in the display area DA of the display panel 110 may constitute a plurality of subpixel rows. The subpixel rows may include any n-th subpixel row SPR(n). Here, n is a natural number greater than or equal to 1.

The plurality of first scan lines SCL1 may include a n-th first scan line SCL1(*n*) corresponding to the n-th subpixel row SPR(n) and a m-th first scan line SCL1(*m*) corresponding to a m-th subpixel row SPR(m).

The plurality of second scan lines SCL2 may include a n-th second scan line SCL2(*n*) corresponding to the n-th subpixel row SPR(n) and a m-th second scan line SCL2(*m*) corresponding to a m-th subpixel row SPR(m).

The plurality of light emission lines EML may include a n-th light emission line EML(n) corresponding to the n-th subpixel row SPR(n) and a m-th light emission line EML(m) corresponding to the m-th subpixel row SPR(m).

The n-th first scan line SCL1(*n*) may supply a n-th first scan signal SCAN1(*n*) to a n-th subpixel SP(n) included in the n-th subpixel row SPR(n).

The n-th second scan line SCL2(*n*) may supply a n-th second scan signal SCAN2(*n*) to a n-th subpixel SP(n) included in the n-th subpixel row SPR(n).

The n-th light emission line EML(n) may supply a n-th light emission signal EM(n) to a n-th subpixel SP(n) included in the n-th subpixel row SPR(n).

The m-th first scan line SCL1(*m*) may supply a m-th first scan signal SCAN1(*m*) to a m-th subpixel SP(m) included in the m-th subpixel row SPR(m).

The m-th second scan line SCL2(*m*) may supply a m-th second scan signal SCAN2(*m*) to a m-th subpixel SP(m) included in the m-th subpixel row SPR(m).

The m-th light emission line EML(m) may supply a m-th light emission signal EM(m) to a m-th subpixel SP(m) included in the m-th subpixel row SPR(m).

Here, in some embodiment, the m-th subpixel row SPR (m) may be the same as the n-th subpixel row SPR(n) or in other embodiments, the m-th subpixel row SPR(m) may be a subpixel row different from the n-th subpixel row SPR(n). That is, according to some embodiments of the present disclosure, m is n or a number different from n, and may be (n+k) or (n−k) (k is a natural number greater than or equal to 1).

If the m-th subpixel row SPR(m) is a subpixel row different from the n-th subpixel row SPR(n), the m-th subpixel row SPR(m) may be (n+1)-th subpixel row SPR (n+1). Alternatively, the m-th subpixel row SPR(m) may be, for any k (a natural number greater than or equal to 1), the (n+k)-th subpixel row SPR(n+k) or the (n−k)-th subpixel row SPR(n−k).

Figure 3B:
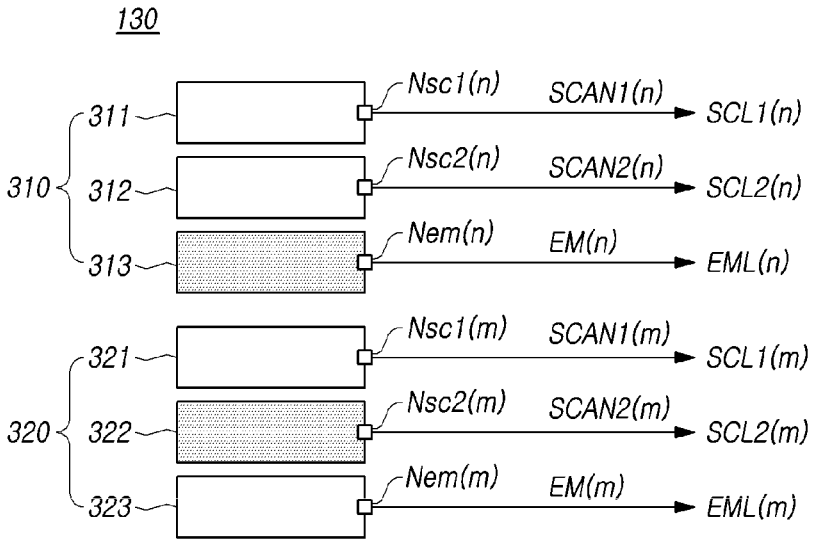
FIG. 3B illustrates a gate driving circuit of a display device according to embodiments of the present disclosure.

FIG. 3B illustrates a gate driving circuit 130 of a display device 100 according to embodiments of the present disclosure.

The gate driving circuit 130 may include a n-th gate driving circuit 310 corresponding to the n-th subpixel SP(n) disposed in the n-th subpixel row SPR(n), and a m-th gate driving circuit 320 corresponding to the m-th subpixel SP(m) disposed in the m-th subpixel row SPR(m).

The n-th gate driving circuit 310 may output the n-th first scan signal SCAN1(*n*) to the n-th subpixel SP(n) included in the n-th subpixel row SPR(n) through the n-th first scan line SCL1(*n*), may output the n-th second scan signal SCAN2(*n*) to the n-th subpixel SP(n) included in the n-th subpixel row SPR(n) through the n-th second scan line SCL2(*n*), and may output the n-th light emission signal EM(n) to the n-th subpixel SP(n) included in the n-th subpixel row SPR(n) through the n-th light emission line EML(n).

The n-th gate driving circuit 310 may include a n-th first scan driver 311 for outputting the n-th first scan signal SCAN1(*n*) to the n-th first scan line SCL1(*n*) through a n-th first scan output terminal Nsc1(*n*), a n-th second scan driver 312 outputting the n-th second scan signal SCAN2(*n*) to the n-th second scan line SCL2(*n*) through a n-th second scan output terminal Nsc2(*n*), and a n-th light emitting driver 313 outputting the n-th light emission signal EM(n) to the n-th light emission line EML(n) through a n-th light emission output terminal Nem(n).

The n-th first scan driver 311 may include a pull-up transistor and a pull-down transistor, and a control circuit for controlling a voltage of each of a gate node (e.g., Q node) of the pull-up transistor and a gate node (e.g., QB node) of the pull-down transistor.

The n-th second scan driver 312 may include a pull-up transistor and a pull-down transistor, and a control circuit for controlling a voltage of each of a gate node (Q node) of the pull-up transistor and a gate node (QB node) of the pull-down transistor.

The n-th light emitting driver 313 may include a pull-up transistor and a pull-down transistor, and a control circuit for controlling a voltage of each of a gate node (Q node) of the pull-up transistor and a gate node (QB node) of the pull-down transistor.

The m-th gate driving circuit 320 may output the m-th first scan signal SCAN1(*m*) to the m-th subpixel SP(m) included in the m-th subpixel row SPR(m) through the m-th first scan line SCL1(*m*), may output the m-th second scan signal SCAN2(*m*) to the m-th subpixel SP(m) included in the m-th subpixel row SPR(m) through the m-th second scan line SCL2(*m*), and may output the m-th light emission signal EM(m) to the m-th subpixel SP(m) included in the m-th subpixel row SPR(m) through the m-th light emission line EML(m).

The m-th gate driving circuit 320 may include a m-th first scan driver 321 for outputting the m-th first scan signal SCAN1(*m*) to the m-th first scan line SCL1(*m*) through a m-th first scan output terminal Nsc1(*m*), a m-th second scan driver 322 outputting the m-th second scan signal SCAN2(*m*) to the m-th second scan line SCL2(*m*) through a m-th second scan output terminal Nsc2(*m*), and a m-th light emitting driver 323 outputting the m-th light emission signal EM(m) to the m-th light emission line EML(m) through a m-th light emission output terminal Nem(m).

The m-th first scan driver 321 may include a pull-up transistor and a pull-down transistor, and a control circuit for controlling a voltage of each of a gate node (Q node) of the pull-up transistor and a gate node (QB node) of the pull-down transistor.

The m-th second scan driver 322 may include a pull-up transistor and a pull-down transistor, and a control circuit for controlling a voltage of each of a gate node (Q node) of the pull-up transistor and a gate node (QB node) of the pull-down transistor.

The m-th light emitting driver 323 may include a pull-up transistor and a pull-down transistor, and a control circuit for controlling a voltage of each of a gate node (Q node) of the pull-up transistor and a gate node (QB node) of the pull-down transistor.

Referring to the drawings below, each subpixel SP disposed on the display panel 110 of the display device 100 according to embodiments of the present disclosure may basically include a light emitting device ED, a driving transistor DRT for driving the light emitting device ED and a storage capacitor Cst.

Each driving transistor DRT has unique characteristic values such as threshold voltage and mobility (e.g., electron mobility). A characteristic value of the driving transistor DRT may change as the driving time increases, so that the transistor characteristic of the driving transistor DRT may change. Accordingly, the current supplied by the driving transistor DRT to the light emitting device ED may change, and thus the light emitting luminance of the light emitting device ED may also change.

However, the plurality of subpixels SP may have different driving times. Accordingly, there may occur a characteristic value deviation between the driving transistors DRT in the plurality of subpixels SP, and thereby occurring a luminance deviation of the plurality of subpixels SP, so that image quality of the display panel 110 may be lowered.

Accordingly, the display device 100 according to one or more embodiments of the present disclosure may provide a compensation function for reducing the deviation in characteristic values between the driving transistors DRT in the plurality of subpixels SP. The compensation function as performed by the display device 100 improves the image quality of the display device by reducing or minimizing luminance deviation between subpixels.

The display device 100 according to some embodiments of the present disclosure may not separately include a sensing configuration (e.g., an analog-to-digital converter, etc.) or a calculation configuration (e.g., a compensation value calculation configuration, etc.) in order to provide a compensation function. Instead, the display device 100 according to some embodiments of the present disclosure may provide a compensation function by driving the subpixel SP so that the corresponding subpixel SP emits light regardless of the threshold voltage of the driving transistor DRT in the subpixel SP. This compensation function may be referred to as an internal compensation function.

Accordingly, each subpixel SP of the display device 100 according to embodiments of the present disclosure may have a structure capable of performing the internal compensation. Hereinafter, an equivalent circuit or structure of the subpixel SP capable of internal compensation is also referred to as a compensation circuit.

Hereinafter, it will be described a compensation circuit and a driving method thereof according to embodiments of the present disclosure with reference to FIGS. 4 to 20.

An N-type transistor-based compensation circuit and a driving method thereof will be described with reference to FIGS. 4 to 9, and a P-type transistor-based compensation circuit and a driving method thereof will be described with reference to FIGS. 10 to 12, and a compensation circuit in which an N-type transistor and a P-type transistor are mixed and a driving method thereof will be described with reference to FIGS. 13 to 18.

The compensation circuits of FIGS. 4, 10, 13, and 16 have the same function and are driven in the same manner, except that only the transistor type is modified. Accordingly, the duplicate descriptions will be omitted. FIG. 19 is a compensation circuit in which one transistor is added to the compensation circuits of FIGS. 4, 10, 13, and 16. The compensation circuit of FIG. 19 is only modified in the transistor type, and has the same function and is driven in the same manner. Accordingly, duplicate descriptions will be omitted.

Referring to FIGS. 4 to 20, a period in which the n-th subpixel SP(n) included in the n-th subpixel row SPR(n) is driven may include an initialization period Tinit, a sampling period Tsam, a writing period Twr, and a light emission period Tem.

Referring to FIGS. 4 to 20, during a period in which the n-th subpixel SP(n) included in the n-th subpixel row SPR(n) is driven, the n-th light emission signal EM(n) may include a first turn-off level voltage section, a first turn-on level voltage section, a second turn-off level voltage section and a second turn-on level voltage section.

The first turn-off level voltage section in the n-th light emission signal EM(n) may correspond to the initialization period Tinit, and the first turn-on level voltage section in the n-th light emission signal EM(n) may correspond to the sampling period Tsam, and the second turn-off level voltage section in the n-th light emission signal EM(n) may correspond to the writing period Twr, and the second turn-on level voltage section in the n-th light emission signal EM(n) may correspond to the light emission period Tem.

Referring to FIGS. 5, 11, 14, and 17, in the display device 100 according to the embodiments of the present disclosure, during a period in which the n-th subpixel SP(n) included in the n-th subpixel row SPR(n) is driven, in the n-th light emission signal EM(n), the rising timing or the falling timing at which the first turn-off level voltage section is changed to the first turn-on level voltage section may be synchronized with the rising timing or the falling timing of the m-th second scan signal SCAN2(*m*).

Referring to FIGS. 4, 5, 8, 10, 11, and 12, in the case that the types of the pull-up transistor and the pull-down transistor included in the n-th light emitting driver 313 are the same as the types of the pull-up transistor and pull-down transistor included in the m-th second scan driver 322 respectively, during a period in which the n-th subpixel SP(n) included in the n-th subpixel row SPR(n) is driven, in the n-th light emission signal EM(n), the falling timing or the rising timing at which the first turn-on level voltage section is changed to the second turn-off level voltage section may be synchronized with the falling timing or the rising timing of the m-th second scan signal SCAN2(*m*).

Referring to FIGS. 13 to 18, in the case that the types of the pull-up transistor and the pull-down transistor included in the n-th light emitting driver 313 are different from the types of the pull-up transistor and pull-down transistor included in the m-th second scan driver 322, during a period in which the n-th subpixel SP(n) included in the n-th subpixel row SPR(n) is driven, in the n-th light emission signal EM(n), the falling timing or the rising timing at which the first turn-on level voltage section is changed to the second turn-off level voltage section may be not synchronized with the falling timing or the rising timing of the m-th second scan signal SCAN2(*m*).

Figure 4:
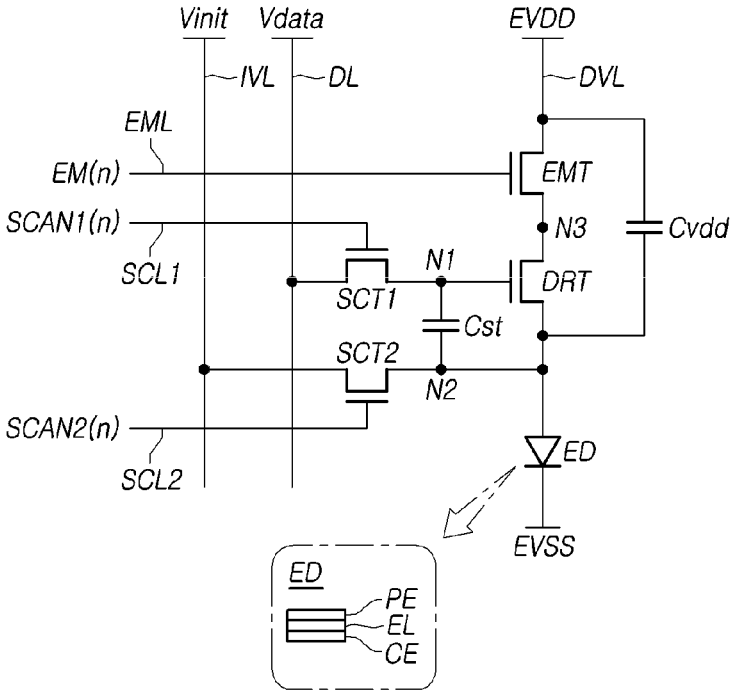
FIG. 4 illustrates a compensation circuit of a display device according to embodiments of the present disclosure.

FIG. 4 illustrates a compensation circuit of a display device 100 according to embodiments of the present disclosure.

FIG. 4 illustrates a compensation circuit which is an equivalent circuit of the n-th subpixel SP(n) included in the n-th subpixel row SPR(n) shown in FIG. 3A.

Referring to FIG. 4, the n-th subpixel SP(n) included in the n-th subpixel row SPR(n) may include a light emitting device ED, a driving transistor DRT for driving light emitting device ED, a first scan transistor SCT1 which is controlled by the n-th first scan signal SCAN1(*n*) and controls an electrical connection between a first node N1 of the driving transistor DRT and a data line DL, a second scan transistor SCT2 which is controlled by the n-th second scan signal SCAN2(*n*) and controls an electrical connection between a second node N2 of the driving transistor DRT and an initialization line IVL, a light emitting transistor EMT which is controlled by the n-th light emission signal EM(n) and controls an electrical connection between a third node N3 of the driving transistor DRT and a driving line DVL, and a storage capacitor Cst connected between the first node N1 and the second node N2 of the driving transistor DRT.

The light emitting device ED may include a pixel electrode PE and a common electrode CE, and may include a light emitting layer EL positioned between the pixel electrode PE and the common electrode CE.

The pixel electrode PE of the light emitting device ED may be an electrode disposed in each subpixel SP, and the common electrode CE may be an electrode commonly disposed in all subpixels SP. Here, the pixel electrode PE may be an anode electrode and the common electrode CE may be a cathode electrode. Conversely, the pixel electrode PE may be a cathode electrode and the common electrode CE may be an anode electrode.

For example, the light emitting device ED may be an organic light emitting diode (OLED), a light emitting diode (LED), or a quantum dot light emitting device.

The driving transistor DRT is a transistor for driving the light emitting device ED, and may include a first node N1, a second node N2, a third node N3, and the like.

The first node N1 of the driving transistor DRT may be a gate node of the driving transistor DRT, and may be electrically connected to a source node or a drain node of a first scan transistor SCT1. The second node N2 of the driving transistor DRT may be a source node or a drain node of the driving transistor DRT, and may be electrically connected to the source node or drain node of a second scan transistor SCT2, and may also be electrically connected to the pixel electrode PE of the light emitting device ED. The third node N3 of the driving transistor DRT may be electrically connected to a driving line DVL supplying a driving voltage EVDD.

The first scan transistor SCT1 may be controlled to be turned on/off according to the n-th first scan signal SCAN1(*n*) supplied through the n-th first scan line SCL1(*n*) electrically connected to the gate node, and may control an electrical connection between the data line DL and the first node N1 of the driving transistor DRT.

The first scan transistor SCT1 may be turned on by the n-th first scan signal SCAN1(*n*) having a turn-on level voltage, and may transfer the data signal Vdata supplied from the data line DL to the first node N1 of the driving transistor DRT.

Here, in the case that the first scan transistor SCT1 is a N-type transistor, the turn-on level voltage of the n-th first scan signal SCAN1(*n*) may be a high-level voltage. In the case that the first scan transistor SCT1 is a P-type transistor, the turn-on level voltage of the n-th first scan signal SCAN1(*n*) may be a low-level voltage.

The second scan transistor SCT2 may be controlled to be turned on/off by the n-th second scan signal SCAN2(*n*) supplied through the n-th second scan line SCL2(*n*) electrically connected to the gate node, and may control an electrical connection between the second node N2 of the driving transistor DRT and an initialization line IVL.

The second scan transistor SCT2 may be turned on by the n-th second scan signal SCAN2(*n*) having a turn-on level voltage, and may transfer an initialization voltage Vinit supplied from the initialization line IVL to the second node N2 of the driving transistor DRT.

Here, in the case that the second scan transistor SCT2 is a N-type transistor, the turn-on level voltage of the n-th second scan signal SCAN2(*n*) may be a high-level voltage. If the second scan transistor SCT2 is a P-type transistor, the turn-on level voltage of the n-th second scan signal SCAN2(*n*) may be a low-level voltage.

The light emitting transistor EMT may be controlled to be turned on/off by the n-th light emission signal EM(n) supplied through the n-th light emission line EML(n) electrically connected to the gate node, and may control an electrical connection between the third node N3 of the driving transistor DRT and a driving line DVL.

The light emitting transistor EMT may be turned on by the n-th light emission signal EM(n) having a turn-on level voltage to transfer the driving voltage EVDD supplied from the driving line DVL to the third node N3 of the driving transistor DRT.

Here, if the light emitting transistor EMT is n N-type transistor, the turn-on level voltage of the n-th light emission signal EM(n) may be a high-level voltage. If the light emitting transistor EMT is a P-type transistor, the turn-on level voltage of the n-th light emission signal EM(n) may be a low-level voltage.

Each of the driving transistor DRT, the first scan transistor SCT1, the second scan transistor SCT2, and the light emitting transistor EMT may be a N-type transistor or a P-type transistor.

In the compensation circuit of FIG. 4, each of the driving transistor DRT, the first scan transistor SCT1, the second scan transistor SCT2, and the light emitting transistor EMT is N-type as an example.

The storage capacitor Cst may be connected between the first node N1 and the second node N2 of the driving transistor DRT. The storage capacitor Cst is charged with an amount of charge corresponding to the voltage difference between both ends, and serves to maintain the voltage difference between both ends for a predetermined frame time (or a selected frame time). Accordingly, during a predetermined frame time (or a selected frame time), the n-th subpixel SP(n) may emit light.

The storage capacitor Cst is not a parasitic capacitor (e.g., Cgs, Cgd) as an internal capacitor existing between the gate node and the source node (or drain node) of the driving transistor DRT, but may be an external capacitor intentionally designed outside the driving transistor DRT.

The structure of the n-th subpixel SP(n) shown in FIG. 4 is only an example, and may be variously modified by further including one or more transistors or further including one or more capacitors.

In addition, at least one of the driving transistor DRT, the first scan transistor SCT1, the second scan transistor SCT2 and the light emitting transistor EMT may be a P-type transistor.

For example, as shown in FIG. 4, all of the driving transistor DRT, the first scan transistor SCT1, the second scan transistor SCT2, and the light emitting transistor EMT may be N-type.

As another example, all of the driving transistor DRT, the first scan transistor SCT1, the second scan transistor SCT2, and the light emitting transistor EMT may be P-type.

As another example, the driving transistor DRT may be a N-type, and the first scan transistor SCT1, the second scan transistor SCT2 and the light emitting transistor EMT may be P-type.

As another example, the driving transistor DRT is a N-type or a P-type, the first scan transistor SCT1 and the second scan transistor SCT2 may be N-type, and the light emitting transistor EMT may be P-type.

As another example, the driving transistor DRT is a N-type or a P-type, and the first scan transistor SCT1 and the second scan transistor SCT2 may be P-type, and the light emitting transistor EMT may be N-type.

Referring to FIG. 4, the n-th subpixel SP(n) included in the n-th subpixel row SPR(n) may further include a capacitor Cvdd connected between the driving line DVL and the second node N2 of the driving transistor DRT.

In the case of the compensation circuit of FIG. 4, all of the first scan transistor SCT1, the second scan transistor SCT2, and the light emitting transistor EMT are N-type transistors. Accordingly, the turn-on level voltage may be referred to as a high-level voltage, and the turn-off level voltage may be referred to as a low-level voltage. Further, in the case of the compensation circuit of FIG. 4 and driving method thereof, m is n+1. Therefore, in some embodiments, "m-th" is also described as "(n+1)-th".

Figure 5:
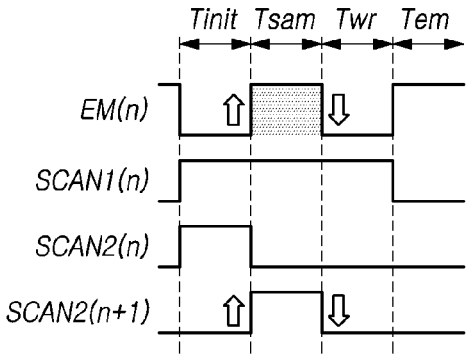
FIG. 5 is a driving timing diagram of a compensation circuit of a display device according to embodiments of the present disclosure.

FIG. 5 is a driving timing diagram of a compensation circuit of a display device 100 according to embodiments of the present disclosure.

Referring to FIG. 5, in the display device 100 according to embodiments of the present disclosure, a period for driving the n-th subpixel SP(n) included in the n-th subpixel row SPR(n) may include an initialization period Tinit, a sampling period Tsam, a writing period Twr, and a light emission period Tem.

During a period in which the n-th subpixel SP(n) included in the n-th subpixel row SPR(n) is driven, the n-th light emission signal EM(n) may include a first low-level voltage section, a first high-level voltage section, a second low-level voltage section, and a second high-level voltage section.

In the n-th light emission signal EM(n), the first low-level voltage section may correspond to the initialization period Tinit. In the n-th light emission signal EM(n), the first high-level voltage section is may correspond to the sampling period Tsam, the second low-level voltage section in the n-th light emission signal EM(n) may correspond to the writing period Twr, and the second high-level voltage section in the n-th light emission signal EM(n) may correspond to the light emission period Tem.

During a period in which the n-th subpixel SP(n) included in the n-th subpixel row SPR(n) is driven, in the n-th light emission signal EM(n), the rising timing at which the first low-level voltage section is changed to the first high-level voltage section may be synchronized with the rising timing of the (n+1)-th second scan signal SCAN2(*n*+1).

The gate driving circuit 130 may include, for the compensation circuit of FIG. 4, a n-th light emitting driver 313 and a (n+1)-th second scan driver 322. In this case, each type of a pull-up transistor and a pull-down transistor included in the n-th light emitting driver 313 and each type of the pull-up transistor and pull-down transistor included in the (n+1)-th second scan driver 322 is all the same as N-type.

In this case, during the period in which the n-th subpixel SP(n) included in the n-th subpixel row SPR(n) is driven, in the n-th light emission signal EM(n), the falling timing at which the first high-level voltage section is changed to the second low-level voltage section may be synchronized with the falling timing of the (n+1)-th second scan signal SCAN2(*n*+1)

Accordingly, during the sampling period Tsam in the period in which the n-th subpixel SP(n) included in the n-th subpixel row SPR(n) is driven, the n-th light emission signal EM(n) may be synchronized with the (n+1)-th second scan signal SCAN2(*n*+1). That is, during the sampling period Tsam in the period in which the n-th subpixel SP(n) included in the n-th subpixel row SPR(n) is driven, the rising timing and the falling timing of the n-th light emission signal EM(n) may be synchronized with the rising timing and the falling timing of the (n+1)-th second scan signal SCAN2(*n*+1).

Hereinafter, referring to FIGS. 6A to 6D, it will be described the initialization period Tinit, the sampling period Tsam, the writing period Twr and the light emission period Tem included in the driving period of the n-th subpixel SP(n) included in the n-th subpixel row SPR(n).

Figure 6A:
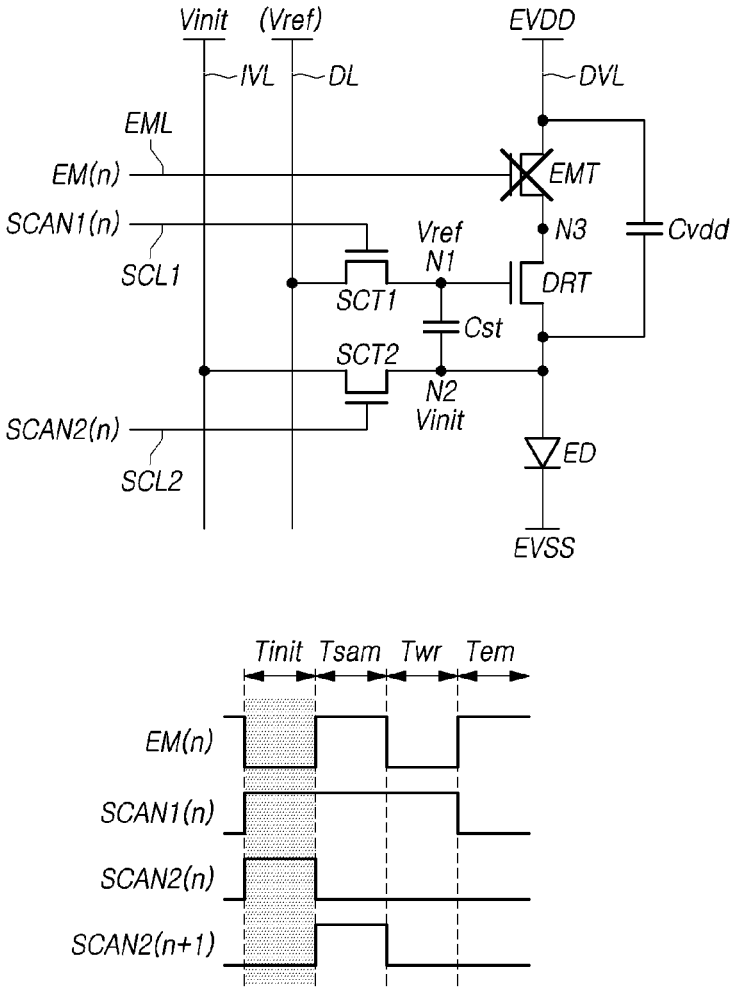
FIG. 6A illustrates an initialization period of a compensation circuit of a display device according to embodiments of the present disclosure.
Figure 6B:
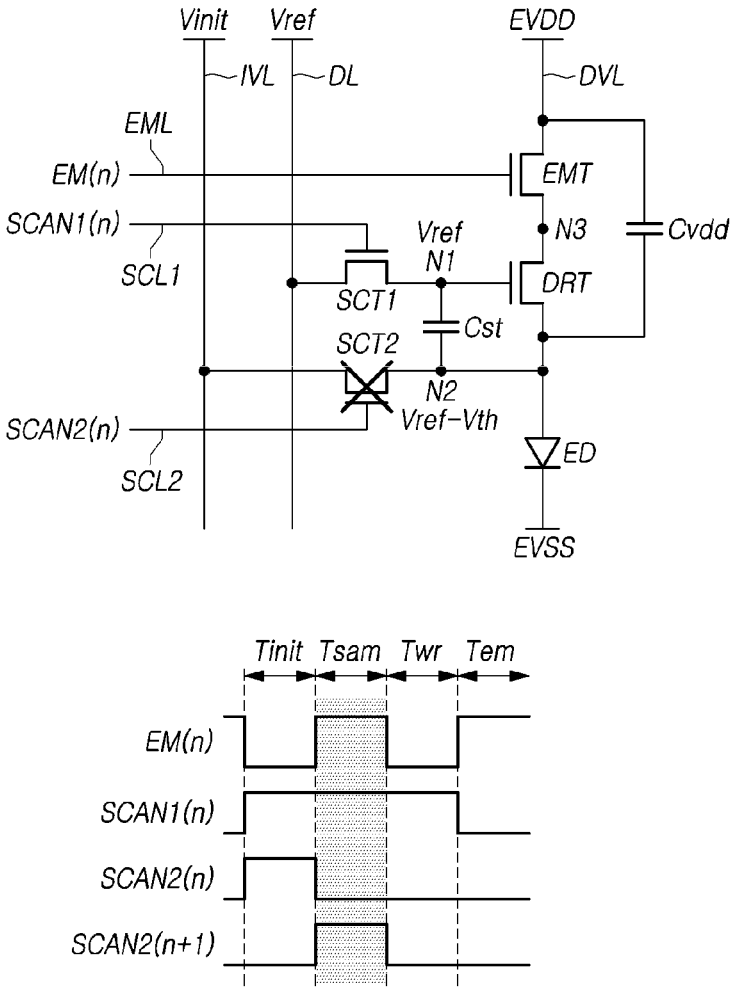
FIG. 6B illustrates a sampling period of a compensation circuit of a display device according to embodiments of the present disclosure.
Figure 6C:
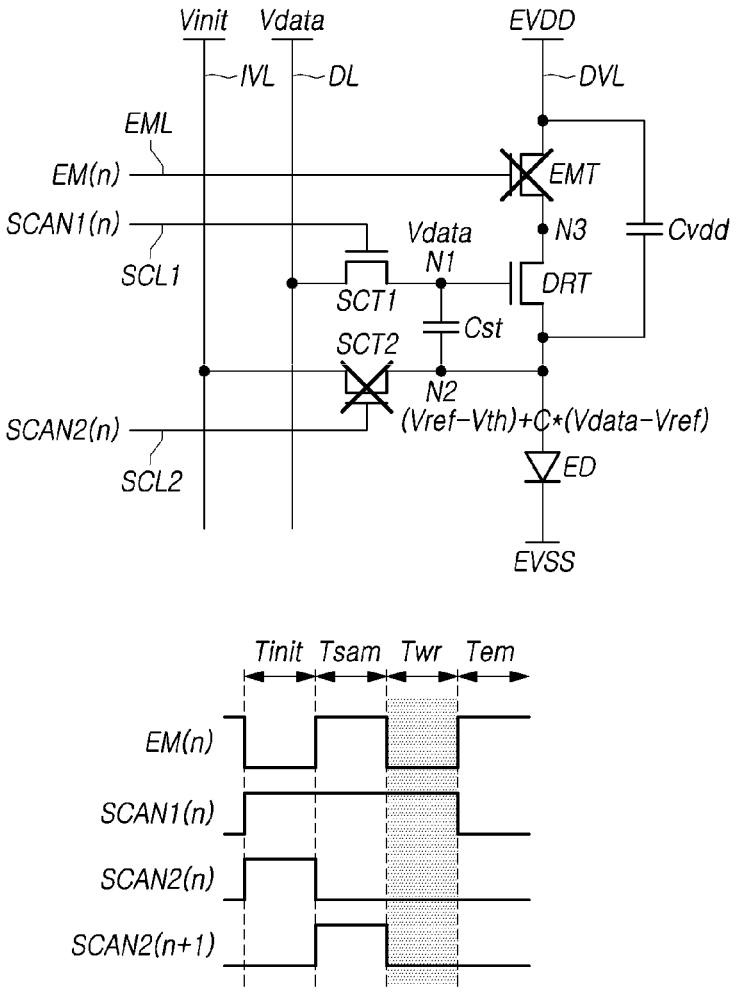
FIG. 6C illustrates a write period of a compensation circuit of a display device according to embodiments of the present disclosure.
Figure 6D:
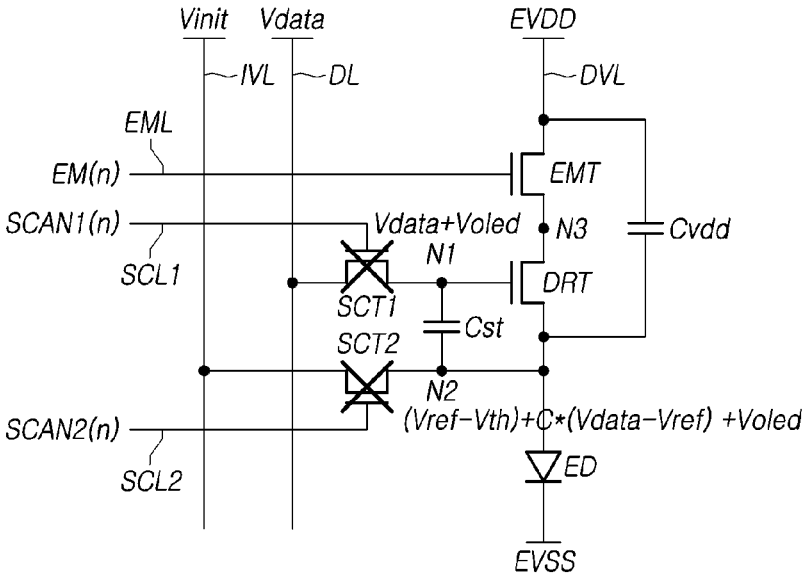
FIG. 6D illustrates a light emission period of a compensation circuit of a display device according to embodiments of the present disclosure.
Figure 6D:
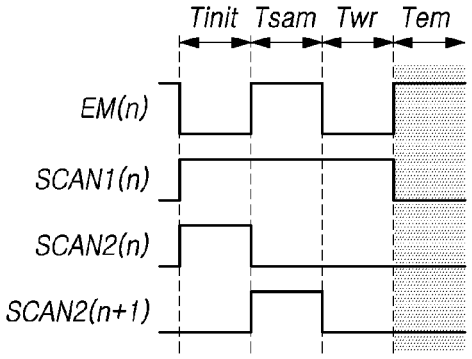

FIG. 6A illustrates an initialization period Tinit of a compensation circuit of a display device 100 according to embodiments of the present disclosure, FIG. 6B illustrates a sampling period Tsam of a compensation circuit of a display device 100 according to embodiments of the present disclosure, FIG. 6C illustrates a writing period Twr of a compensation circuit of a display device 100 according to embodiments of the present disclosure, and FIG. 6D illustrates an light emission period Tem of a compensation circuit of a display device 100 according to embodiments of the present disclosure.

Referring to FIG. 6A, during the initialization period Tinit, the n-th light emission signal EM(n) has a low-level voltage. Accordingly, the light emitting transistor EMT has a turn-off state.

During the initialization period Tinit, the n-th first scan signal SCAN1(*n*) has a high-level voltage. Accordingly, the first scan transistor SCT1 is turned on, and a reference voltage Vref output from the data driving circuit 120 and supplied to the data line DL is applied to the first node N1 of the driving transistor DRT through the turned-on first scan transistor SCT1. Here, the reference voltage Vref is a data voltage output to the data line DL during the initialization period Tinit.

During the initialization period Tinit, the n-th second scan signal SCAN2(*n*) has a high-level voltage. Accordingly, the second scan transistor SCT2 is in a turn-on state, and an initialization voltage Vinit supplied to the initialization line IVL is applied to the second node N2 of the driving transistor DRT through the turned-on second scan transistor SCT2.

As described above, during the initialization period Tinit, the voltage of the first node N1 and the second node N2 of the driving transistor DRT may be initialized to the reference voltage Vref and the initialization voltage Vint, respectively.

Referring to FIG. 6B, during the sampling period Tsam, the n-th light emission signal EM(n) has a high-level voltage. Accordingly, the light emitting transistor EMT is turned on.

During the sampling period Tsam, the n-th first scan signal SCAN1(*n*) maintains a high-level voltage. Accordingly, the first node N1 of the driving transistor DRT maintains a state in which the reference voltage Vref is applied.

During the sampling period Tsam, the n-th second scan signal SCAN2(*n*) is changed to a low-level voltage. Accordingly, the second scan transistor SCT2 is turned off, and thus, the second node N2 of the driving transistor DRT is electrically in a floating state.

During the sampling period Tsam, the reference voltage Vref is applied to the first node N1 of the driving transistor DRT, and the second node N2 of the driving transistor DRT is electrically floating. Accordingly, in this state, the voltage of the second node N2 of the driving transistor DRT increases.

The increasing of the voltage of the second node N2 of the driving transistor DRT may be performed until the voltage difference between the first node N1 and the second node N2 of the driving transistor DRT becomes the threshold voltage Vth of the driving transistor DRT.

When the voltage difference between the first node N1 and the second node N2 of the driving transistor DRT becomes the threshold voltage Vth of the driving transistor DRT, the voltage of the second node N2 of the driving transistor DRT is saturated.

The saturated voltage of the second node N2 of the driving transistor DRT may be a voltage Vrer−Vth which is different from the voltage Vref of the first node N1 of the driving transistor DRT by the threshold voltage Vth.

As described above, in the period in which the n-th subpixel SP(n) included in the n-th subpixel row SPR(n) is driven, during a period in which the n-th light emission signal EM(n) is the first high-level voltage section, the voltage of the second node N2 of the driving transistor DRT may be boosted, and the voltage difference between the first node N1 and the second node N2 of the driving transistor DRT may become the threshold voltage of the driving transistor DRT.

Referring to FIG. 6C, during the writing period Twr, the n-th light emission signal EM(n) is changed back to a low-level voltage. Accordingly, the light emitting transistor EMT has a turn-off state.

During the writing period Twr, the n-th first scan signal SCAN1(*n*) continues to maintain a high-level voltage. Accordingly, the first scan transistor SCT1 continuously maintains the turn-on state.

During the writing period Twr, the data driving circuit 120 does not output the reference voltage Vref to the data line DL, but outputs a data voltage Vdata corresponding to the image signal to the data line DL.

Accordingly, the data voltage Vdata output to the data line DL is applied to the first node N1 of the driving transistor DRT through the turned-on first scan transistor SCT1.

During the writing period Twr, the n-th second scan signal SCAN2(*n*) maintains a low-level voltage. Accordingly, the second node N2 of the driving transistor DRT is in an electrically floating state.

Therefore, while the voltage difference between the first node N1 and the second node N2 of the driving transistor DRT maintains the voltage difference value Vth in the sampling period Tsam, the voltage of the second node N2 of the driving transistor DRT may be changed from the voltage value Vref−Vth in the sampling period Tsam by the voltage change amount Vdata−Vref of the first node N1 of the driving transistor DRT. That is, the voltage of the second node N2 of the driving transistor DRT may become Vref−Vth+C*(Vdata−Vref).

Here, C is a capacitance constant, and may be determined by a capacitance value (a) of the storage capacitor Cst and a capacitance value (b) of a driving capacitance Cvdd. For example, the capacitance constant C may be obtained by dividing the capacitance value (a) of the storage capacitor Cst by the sum of the capacitance value (a) of the storage capacitor Cst and the capacitance value (b) of the driving capacitance Cvdd (i.e., C=a/(a+b)).

Referring to FIG. 6D, during the light emission period Tem, the n-th light emission signal EM(n) is changed to a high-level voltage again. Accordingly, the light emitting transistor EMT has a turn-on state.

During the light emission period Tem, the n-th first scan signal SCAN1(*n*) is changed to a low-level voltage. Accordingly, the first scan transistor SCT1 is turned off. Accordingly, the first node N1 of the driving transistor DRT is in an electrically floating state.

During the light emission period Tem, the n-th second scan signal SCAN2(*n*) maintains a low-level voltage. Accordingly, the second node N2 of the driving transistor DRT is in an electrically floating state.

During the light emission period Tem, the driving transistor DRT supplies a current to the light emitting device ED, and the light emitting device ED emits light by the supplied current.

In this case, according to the voltage Voled (hereinafter, referred to as a light emitting device voltage) of the pixel electrode PE of the light emitting device ED, the voltage of the second node N2 of the driving transistor DRT has a voltage value Vref−Vth+C*(Vdata−Vref)+Voled which is added by the light emitting device voltage Voled from the previous voltage value Vref−Vth+C*(Vdata−Vref). In addition, the voltage of the first node N1 of the driving transistor DRT has a voltage value Vdata+Voled obtained by adding the light emitting device voltage Voled to the data voltage Vdata.

A current Ioled flowing through the light emitting device ED has the following Equation (1).

$$\begin{aligned} Ioled &= k \times (Vgs - Vth)^2 \\ &= k \times (Vdata + Voled - ((Vref - Vth) + C \times (Vdata - Vref) + Voled) - Vth)^2 \\ &= k \times (Vdata - Vref - C \times (Vdata - Vref))^2 \end{aligned} \quad \text{Equation 1}$$

In Equation 1, Ioled is a current flowing through the light emitting device ED, k is a constant determined by the physical properties of the driving transistor DRT, Vgs is the potential difference between the first node N1 and the second node N2 of the driving transistor DRT, Vth is a threshold voltage of the driving transistor DRT, Vdata is a data voltage, Vref is a reference voltage, Voled is a light emitting device voltage, and C is a capacitance constant.

In Equation 1, the threshold voltage Vth of the driving transistor DRT is removed, so that the current Ioled flowing through the light emitting device ED is not affected by the threshold voltage Vth of the driving transistor DRT.

Figure 7:
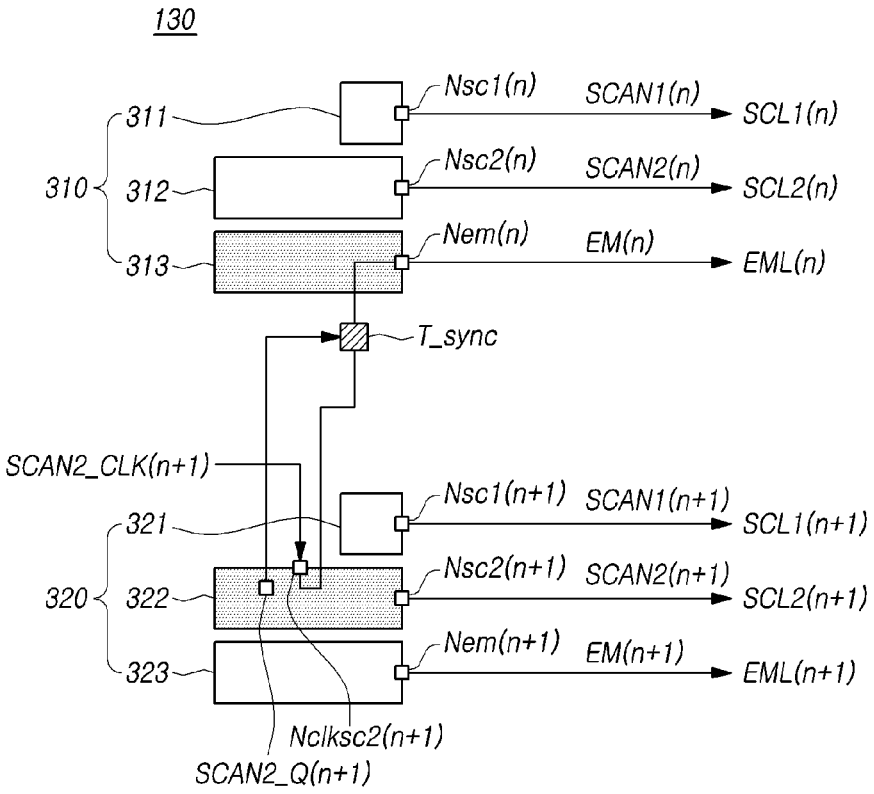
FIGS. 7 and 8 illustrate examples of a gate driving circuit according to embodiments of the present disclosure.
Figure 8:
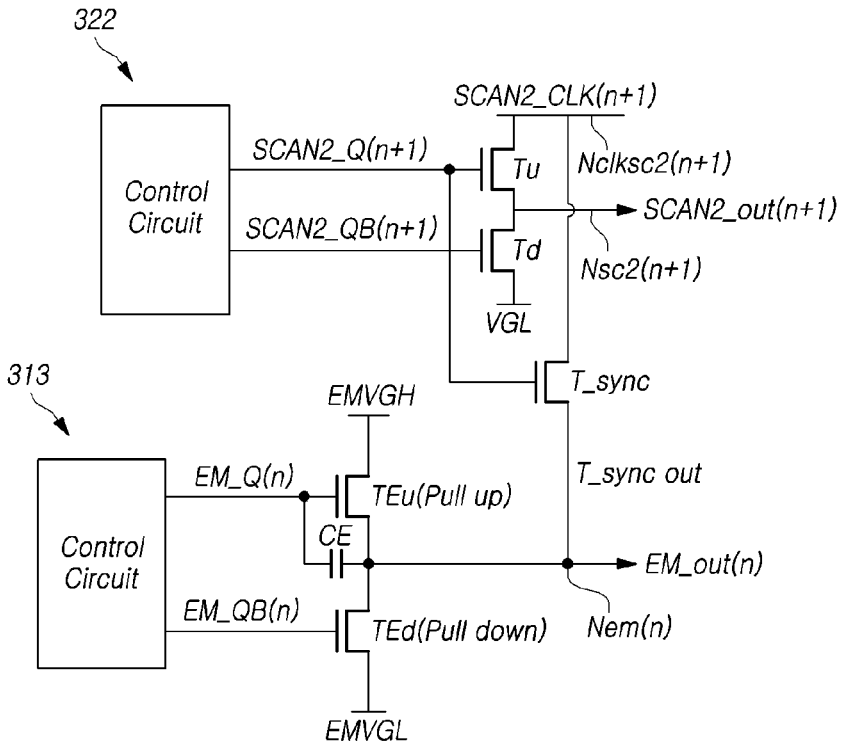
Figure 9:
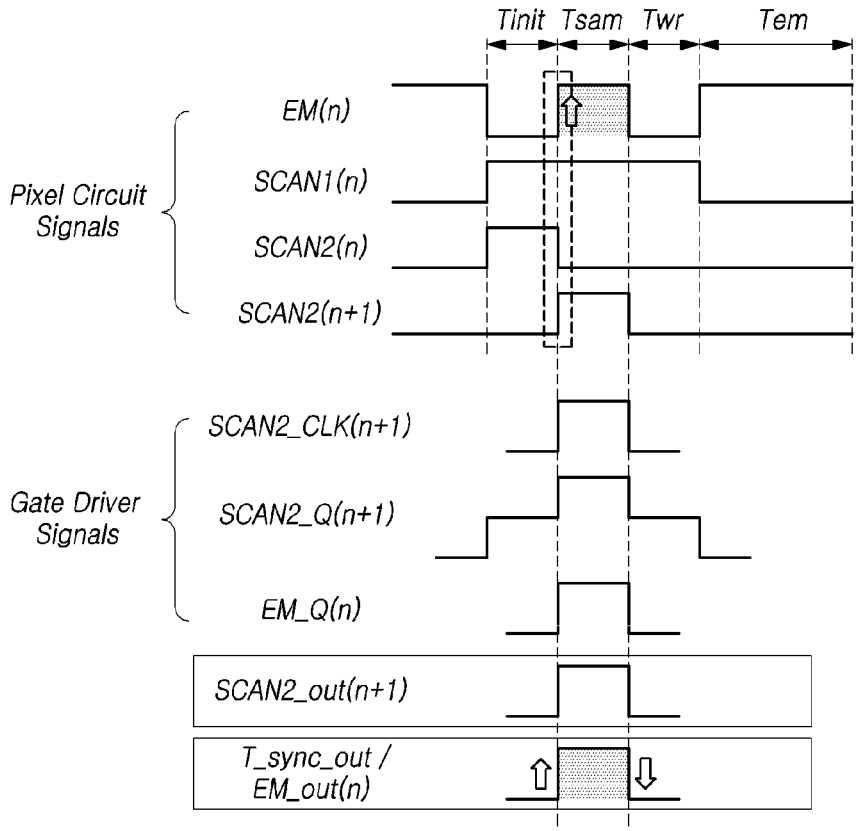
FIG. 9 is a diagram for explaining operations of a compensation circuit and a gate driving circuit in a display device according to embodiments of the present disclosure.

FIGS. 7 and 8 illustrate examples of a gate driving circuit 130 according to embodiments of the present disclosure. FIG. 9 is a diagram for explaining operations of a compensation circuit and a gate driving circuit 130 in a display device 100 according to embodiments of the present disclosure.

Referring to FIG. 7, the gate driving circuit 130 for the compensation circuit of FIG. 4 may include a n-th gate driving circuit 310 and an (n+1)-th gate driving circuit 320.

The n-th gate driving circuit 310 may include a n-th first scan driver 311 for outputting the n-th first scan signal SCAN1(*n*) to the n-th first scan line SCL1(*n*) through a n-th first scan output terminal Nsc1(*n*), a n-th second scan driver 312 for outputting the n-th second scan signal SCAN2(*n*) to the n-th second scan line SCL2(*n*) through a n-th second scan output terminal Nsc2(*n*), and a n-th light emitting driver 313 for outputting the n-th light emission signal EM(n) to the n-th light emission line EML(n) through the a n-th light emission output terminal Nem(n).

The n-th first scan driver 311 may include a pull-up transistor and a pull-down transistor, and a control circuit for controlling voltages of a gate node (Q node) of the pull-up transistor and a gate node (QB node) of the pull-down transistor, respectively.

The n-th second scan driver 312 may include a pull-up transistor and a pull-down transistor, and a control circuit for controlling voltages of a gate node (Q node) of the pull-up transistor and a gate node (QB node) of the pull-down transistor, respectively.

The n-th light emitting driver 313 may include a pull-up transistor TEu and a pull-down transistor TEd, and a control circuit for controlling the voltage of each of a gate node (Q node) EM_Q(n) of the pull-up transistor TEu and a gate node (QB node) EM_QB(n) of the pull-down transistor TEd.

The (n+1)-th gate driving circuit 320 may include a (n+1)-th first scan driver 321 for outputting the (n+1)-th first scan signal SCAN1(*n*+1) to the (n+1)-th first scan line SCL1(*n*+1) through a (n+1)-th first scan output terminal Nsc1(*n*+1), a (n+1)-th second scan driver 322 for outputting the (n+1)th second scan signal SCAN2(*n*+1) to the (n+1)-th second scan line SCL2(*n*+1) through a (n+1)-th second scan output terminal Nsc2(*n*+1), and a (n+1)-th light emitting driver 323 for outputting the (n+1)-th light emission signal EM(n+1) to the (n+1)-th light emission line EML(n+1) through the a (n+1)-th light emission output terminal Nem (n+1).

The (n+1)-th first scan driver 321 may include a pull-up transistor and a pull-down transistor, and a control circuit for controlling voltages of a gate node (Q node) of the pull-up transistor and a gate node (QB node) of the pull-down transistor, respectively.

The (n+1)-th second scan driver 322 may include a pull-up transistor Tu and a pull-down transistor Td, and a control circuit for controlling voltages of a gate node (Q node) SCAN2_Q(n+1) of the pull-up transistor Tu and a gate node (QB node) SCAN2_QB(n+1) of the pull-down transistor Td, respectively.

The (n+1)-th light emitting driver 323 may include a pull-up transistor and a pull-down transistor, and a control circuit for controlling the voltage of each of a gate node (Q node) of the pull-up transistor and a gate node (QB node) of the pull-down transistor.

Referring to FIG. 8, in the compensation circuit of FIG. 4, since the first scan transistor SCT1, the second scan transistor SCT2, and the light emitting transistor EMT are N-type transistors, the pull-up transistor TEu and the pull-down transistor TEd included in the n-th light emitting driver 313 are N-type transistors, and the pull-up transistor Tu and the pull-down transistor Td included in the (n+1)-th second scan driver 322 are N-type transistors.

In the (n+1)-th second scan driver 322, the pull-up transistor Tu is controlled to be turned on/off by the voltage of the Q node SCAN2_Q(n+1), and controls the connection between the clock input terminal Nclksc2(*n*+1) and the (n+1)-th second scan output terminal Nsc2(*n*+1). The pull-down transistor Td is controlled to be turned on/off by the voltage of the QB node SCAN2_QB(n+1), controls the connection between a node to which the low-level gate voltage VGL is applied and the (n+1)-th second output terminals Nsc2(*n*+1).

In the n-th light emitting driver 313, the pull-up transistor TEu is controlled to be turned on/off by the voltage of the Q node EM_Q(n), and controls the connection between a node to which the high-level gate voltage EMVGH is applied and a n-th light emission output terminal Nem(n). The pull-down transistor TEd is turned on and off by the voltage of the QB node EM_QB(n), and controls the connection between the node to which the low-level gate voltage EMVGL is applied and the n-th light emission output terminal Nem(n).

The n-th light emitting driver 313 may further include a capacitor CE connected between the gate node EM_Q(n) and the source node Nem(n) of the pull-up transistor TEu.

Referring to FIGS. 7 and 8, the display device 100 according to embodiments of the present disclosure may further include a synchronization transistor T_sync. The synchronization transistor T_sync is controlled according to the voltage of the Q node SCAN2_Q(n+1) of the (n+1)-th second scan driver 322, controls an electrical connection between the n-th light emission output terminal Nem(n) and a clock input terminal Nclksc2(*n*+1) of the (n+1)-th second scan driver 322. Here, the synchronization transistor T_sync may be included in the gate driving circuit 130 or included in the display panel 110.

Referring to FIG. 8, the signal SCAN2_out(n+1) output from the (n+1)-th second scan driver 322 may be the same signal as the (n+1)-th second scan signal SCAN2(*n*+1). The signal EM_out(n) output from the n-th light emitting driver 313 may be the same signal as the n-th light emission signal EM(n).

Referring to FIG. 8, the synchronization transistor T_sync may be a N-type transistor.

Also, referring to FIG. 8, the type of the synchronization transistor T_sync may be the same as that of each of the first scan transistor SCT1 and the second scan transistor SCT2 as a N-type.

Further, referring to FIG. 8, the types of the synchronization transistor T_sync may be the same as each type of the pull-up transistor Tu and the pull-down transistor Td included in the (n+1)-th second scan driver 322 as N-type.

Referring to FIG. 9, in the (n+1)-th second scan driver 322, when the voltage of the Q node SCAN2_Q(n+1) primarily rises, the synchronization transistor T_sync is turned on. In this case, the (n+1)-th second scan signal SCAN2(*n*+1) is a low-level voltage, and the Q node EM_Q(n) of the n-th light emitting driver 313 is a low-level voltage.

Accordingly, the turned-on synchronization transistor T_sync outputs the low-level voltage of the (n+1)-th second scan signal SCAN2(*n*+1) as the output signal T_sync_out. The output signal T_sync_out of the turned-on synchronization transistor T_sync is applied to the n-th light emission output terminal Nem(n) of the n-th light emitting driver 313. That is, through the turned-on synchronization transistor T_sync, the low-level voltage of the (n+1)-th second scan signal SCAN2(*n*+1) is applied to the n-th light emission output terminal Nem(n) of the n-th light emitting driver 313.

The output signal EM_out(n) of the n-th light emitting driver 313 is a low-level voltage of the (n+1)-th second scan signal SCAN2(*n*+1), and is the output signal T_sync_out of the synchronization transistor T_sync, and is the n-th light emission signal EM(n) having a low-level voltage during the initialization period Tinit.

Referring to FIG. 9, in the (n+1)-th second scan driver 322, when the voltage of the Q node SCAN2_Q(n+1) is secondarily increased (boosted), the synchronization transistor T_sync is continuously turned-on. In this case, the (n+1)-th second scan signal SCAN2(*n*+1) is a high-level voltage, and the Q node EM_Q(n) of the n-th light emitting driver 313 is a high-level voltage.

Accordingly, in the (n+1)-th second scan driver 322, the synchronization transistor T_sync may be completely turned on by the boosted high voltage of the Q node SCAN2_Q(n+1). Accordingly, the synchronization transistor T_sync outputs the high-level voltage of the (n+1)-th second scan signal SCAN2(*n*+1) as the output signal T_sync_out. The output signal T_sync_out of the turned-on synchronization transistor T_sync is applied to the n-th light emission output terminal Nem(n) of the n-th light emitting driver 313. That is, through the turned-on synchronization transistor T_sync, the high-level voltage of the (n+1)-th second scan signal SCAN2(*n*+1) is applied to the n-th light emission output terminal Nem(n).

In addition, since the Q node EM_Q(n) of the n-th light emitting driver 313 is a high-level voltage, the high-level gate voltage EMVGH may be output to the n-th light emission output terminal Nem(n) through the pull-up transistor TEu.

The output signal EM_out(n) of the n-th light emitting driver 313 is the high-level gate voltage EMVGH, the high-level voltage of the (n+1)-th second scan signal SCAN2(*n*+1), an output signal T_sync_out of the synchronization transistor T_sync, and a n-th light emission signal EM(n) having a high-level voltage during the sampling period Tsam.

As described above, the timing at which the n-th light emission signal EM(n) rises from the low-level voltage to the high-level voltage EMVGH may be synchronized with the timing of rising from the low-level voltage to the high-level voltage of the (n+1)-th second scan signal SCAN2(*n*+1).

In this case, in the (n+1)-th second scan driver 322, since the Q node (SCAN2_Q(n+1)) is boosted with a high voltage, the synchronization transistor T_sync may be completely turned, thereby greatly improving the rising characteristic of the n-th light emission signal EM(n).

Referring to FIG. 9, in the (n+1)-th second scan driver 322, when the voltage of the Q node SCAN2_Q(n+1) is primarily falled, the falled voltage is also a high-level voltage, therefore, the synchronization transistor T_sync maintains a turn-on state.

At this time, the (n+1)-th second scan signal SCAN2(*n*+1) is a low-level voltage, and the Q node EM_Q(n) of the n-th light emitting driver 313 is a low-level voltage, and the QB node EM_QB(n) of the n-th light emitting driver 313 is a high-level voltage.

Accordingly, the turned-on synchronization transistor T_sync outputs the low-level voltage of the (n+1)-th second scan signal SCAN2(*n*+1) as the output signal T_sync_out. The output signal T_sync_out of the turned-on synchronization transistor T_sync is applied to the n-th light emission output terminal Nem(n) of the n-th light emitting driver 313. That is, through the turned-on synchronization transistor T_sync, the low-level voltage of the (n+1)-th second scan signal SCAN2(*n*+1) is applied to the n-th light emission output terminal Nem(n).

In addition, since the QB node EM_QB(n) of the n-th light emitting driver 313 is a high-level voltage, the low-level gate voltage EMVGL is applied to the n-th light emission output terminal Nem(n) through the pull-down transistor TEd.

The output signal EM_out(n) of the n-th light emitting driver 313 is a low-level gate voltage EMVGL, and a low-level of the (n+1)-th second scan signal SCAN2(*n*+1), and the output signal T_sync_out of the synchronization transistor T_sync, and a n-th light emission signal EM(n) having a low-level voltage during the writing period Twr.

As described above, the timing at which the n-th light emission signal EM(n) is falled from the high-level voltage to the low-level voltage EMVGL may be synchronized with the timing of falling from the high-level voltage to the low-level voltage of the (n+1)-th second scan signal SCAN2 (*n*+1).

According to the above-described operation using the synchronization transistor T_sync, during a period in which the n-th subpixel SP(n) included in the n-th subpixel row SPR(n) is driven, in the n-th light emission signal EM(n), the rising timing at which the first low-level voltage section is changed to the first high-level voltage section may be synchronized with the rising timing of the (n+1)-th second scan signal SCAN2(*n*+1). Further, in the n-th light emission signal EM(n), the falling timing at which the first high-level voltage section is changed to the second low-level voltage section may be synchronized with the falling timing of the (n+1)-th second scan signal SCAN2(*n*+1).

Accordingly, at a start timing of the sampling period Tsam, the length at which the n-th light emission signal EM(n) rises may be shortened. Accordingly, the internal compensation time may be longer.

In addition, at the end timing of the sampling period Tsam, the falling length of the n-th light emission signal EM(n) may be shortened. Accordingly, the input time of the data voltage Vdata, which is the image signal, is increased, and thus the compensation rate may be increased.

Accordingly, the on-off operation timing of the (n+1)-th second scan signal SCAN2(*n*+1) and the n-th light emission signal EM(n) in the sampling period Tsam are synchronized with each other, so that the compensation rate may be improved.

Figure 10:
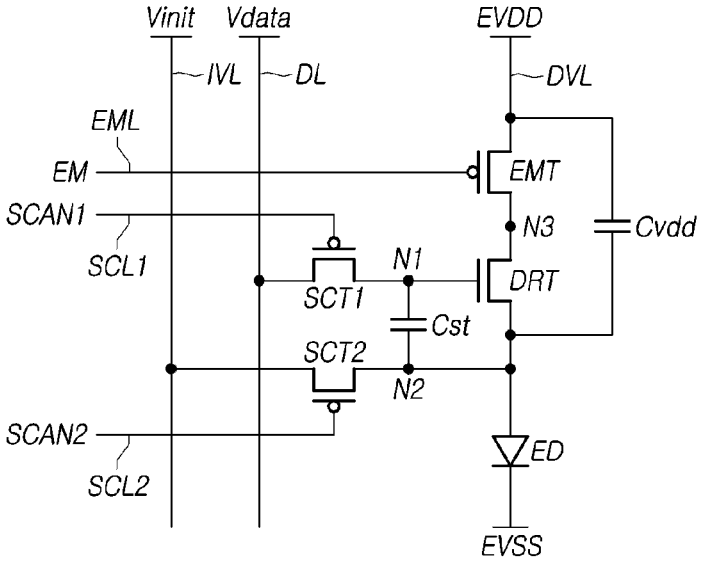
FIG. 10 illustrates a compensation circuit modified from the compensation circuit of FIG. 4.
Figure 11:
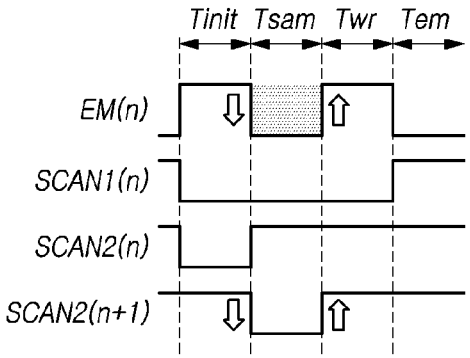
FIG. 11 is a driving timing diagram of the compensation circuit of FIG. 10.
Figure 12:
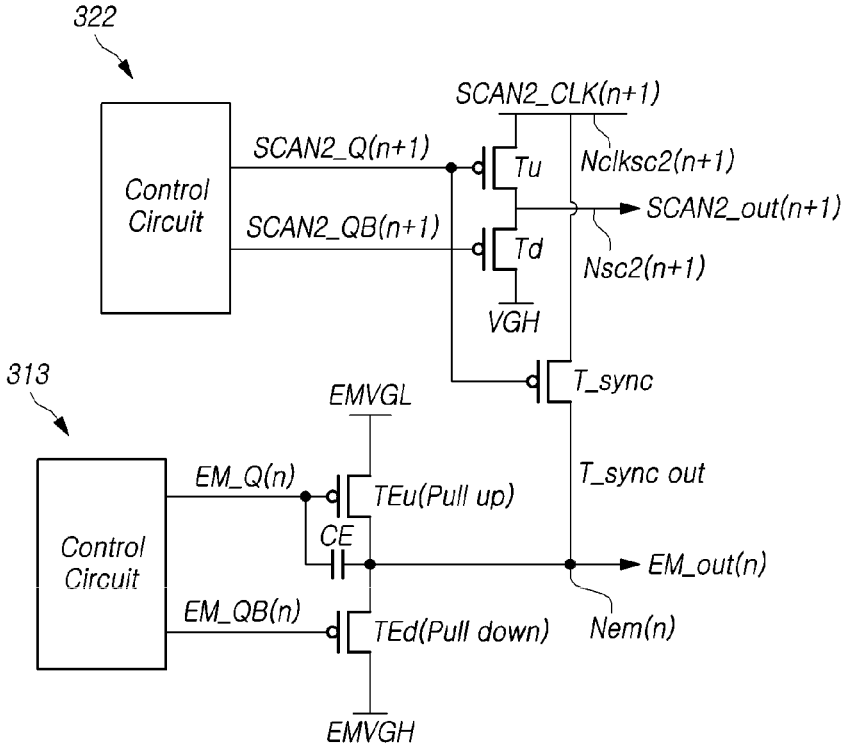
FIG. 12 illustrates a gate driving circuit for the compensation circuit of FIG. 10.

FIG. 10 illustrates a compensation circuit modified from the compensation circuit of FIG. 4, FIG. 11 is a driving timing diagram of the compensation circuit of FIG. 10, and FIG. 12 illustrates a gate driving circuit 130 for the compensation circuit of FIG. 10.

In the compensation circuit of FIG. 10, the first scan transistor SCT1, the second scan transistor SCT2, and the light emitting transistor EMT are all P-type transistors. Only in this respect, the compensation circuit of FIG. 10 is different from the compensation circuit of FIG. 4 and the rest of the configuration is the same.

Referring to FIG. 10, since the first scan transistor SCT1, the second scan transistor SCT2, and the light emitting transistor EMT are all P-type transistors, the turn-on level voltage of each of the first scan transistor SCT1 and the second scan transistor SCT2 and the light emitting transistor EMT is a low-level voltage. The turn-off level voltage of each of the first scan transistor SCT1, the second scan transistor SCT2 and the light emitting transistor EMT is a high-level voltage.

Accordingly, the driving timing diagram of the compensation circuit of FIG. 10 shown in FIG. 11 is also the same as the driving timing diagram of the compensation circuit of FIG. 4 shown in FIG. 5 except for a change in voltage level.

Referring to FIG. 11, during a period in which the n-th subpixel SP(n) included in the n-th subpixel row SPR(n) is driven, the n-th light emission signal EM(n) may include a first high-level voltage section, a first low-level voltage section, a second high-level voltage section, and a second low-level voltage section.

During the driving period of the n-th subpixel SP(n) included in the n-th subpixel row SPR(n), in the n-th light emission signal EM(n), the first high-level voltage section may correspond to an initialization period Tinit, the first low-level voltage section may correspond to a sampling period Tsam, the second high-level voltage section may correspond to a writing period Twr, and the second low-level voltage section may correspond to a light emission period Tem.

During a period in which the n-th subpixel SP(n) included in the n-th subpixel row SPR(n) is driven, in the n-th light emission signal EM(n), the falling timing at which the first high-level voltage section is changed to the first low-level voltage section may be synchronized with the falling timing of the m-th second scan signal SCAN2(*m*).

In the synchronization method applied to the compensation circuit of FIG. 10, m is (n+1). Accordingly, during the driving period of the n-th subpixel SP(n) included in the n-th subpixel row SPR(n), in the n-th light emission signal EM(n), the falling timing at which the first high-level voltage section is changed to the first low-level voltage section may be synchronized with the falling timing of the (n+1)-th second scan signal SCAN2(*n*+1).

Referring to FIG. 12, the gate driving circuit 130 may include a n-th light emitting driver 313 and a (n+1)-th second scan driver 322 for the compensation circuit of FIG. 10. Each type of a pull-up transistor TEu and a pull-down transistor TEd included in the n-th light emitting driver 313 and each type of a pull-up transistor Tu and a pull-down transistor Td included in the (n+1)-th second scan driver 322 are the same as P-type.

In this case, during a period in which the n-th subpixel SP(n) included in the n-th subpixel row SPR(n) is driven, in the n-th light emission signal EM(n), the rising timing at which the first low-level voltage section is changed to the second high-level voltage section may be synchronized with the rising timing of the (n+1)-th second scan signal SCAN2 (*n*+1).

Accordingly, during the sampling period Tsam in the period in which the n-th subpixel SP(n) included in the n-th subpixel row SPR(n) is driven, the n-th light emission signal EM(n) may be the same as the (n+1)-th second scan signal SCAN2(*n*+1). That is, during the sampling period Tsam in the period in which the n-th subpixel SP(n) included in the n-th subpixel row SPR(n) is driven, the falling timing and the rising timing of the n-th light emission signal EM(n) may be synchronized with the falling timing and the rising timing of the (n+1)-th second scan signal SCAN2(*n*+1).

Referring to FIGS. 10 and 12, in the case that a first scan transistor SCT1, a second scan transistor SCT2, and a light emitting transistor EMT in a compensation circuit as an equivalent circuit of the n-th subpixel SP(n) are P-type transistors, the n-th light emitting driver 313 may include a pull-up transistor TEu and a pull-down transistor TEd that are P-type transistors, and an (n+1)-th second scan driver 322 may include a pull-up transistor Tu and a pull-down transistor Td that are P-type transistors.

Referring to FIG. 12, in the (n+1)-th second scan driver 322, the pull-up transistor Tu may be controlled to be turned on/off by the voltage of the Q node SCAN2_Q(n+1), and may control the connection between the clock input terminal Nclksc2(*n*+1) and the (n+1)-th second scan output terminal Nsc2(*n*+1). The pull-down transistor Td is controlled to be turned on/off by the voltage of the QB node SCAN2_QB (n+1), and controls the connection between a node applying the high-level gate voltage VGH and the (n+1)-th second scan output terminals Nsc2(*n*+1).

In the n-th light emitting driver 313, the pull-up transistor TEu is controlled to be turned on/off by the voltage of the Q node EM_Q(n), and controls the connection between a node to which the low-level gate voltage EMVGL is applied and the n-th light emission output terminal Nem(n). The pull-down transistor TEd is controlled to be turned on and off by the voltage of the QB node EM_QB(n), and controls the connection between the node to which the high-level gate voltage EMVGH is applied and the n-th light emission output terminal Nem(n).

As described above, during the sampling period Tsam in the period in which the n-th subpixel SP(n) included in the n-th subpixel row SPR(n) is driven, the synchronization between the n-th light emission signal EM(n) and the (n+1)-th second scan signal SCAN2(*n*+1) may be enabled by a synchronization transistor T_sync.

The synchronization transistor T_sync may be controlled according to the voltage of the Q node SCAN2_Q(n+1) of the (n+1)-th second scan driver 322, and may control an electrical connection between the light emission output terminal Nem(n) and the clock input terminal Nclksc2(*n*+1) of the (n+1)-th second scan driver 322. Here, the synchronization transistor T_sync may be included in the gate driving circuit 130 or included in the display panel 110.

The operation method of the synchronization transistor T_sync that enables synchronization between the n-th light emission signal EM(n) and the (n+1)-th second scan signal SCAN2(*n*+1) is the same as the method described above with reference to FIG. 9 except that the transistor type and various voltage levels changed accordingly.

Referring to FIG. 12, the synchronization transistor T_sync may be a P-type transistor. The type of the synchronization transistor T_sync may be the same as that of each of the first scan transistor SCT1 and the second scan transistor SCT2 as a P-type. The type of the synchronization transistor T_sync is the same as that of each of the pull-up transistor Tu and the pull-down transistor Td included in the (n+1)-th second scan driver 322 as a P-type.

According to the above-described operation using the synchronization transistor T_sync, during a period in which the n-th subpixel SP(n) included in the n-th subpixel row SPR(n) is driven, in the n-th light emission signal EM(n), the falling timing at which the first high-level voltage section is changed to the first low-level voltage section may be synchronized with the falling timing of the (n+1)-th second scan signal SCAN2(*n*+1). And, in the n-th light emission signal EM(n), the rising timing at which the first low-level voltage section is changed to the second high-level voltage section may be synchronized with the rising timing of the (n+1)-th second scan signal SCAN2(*n*+1).

Accordingly, at a start timing of the sampling period Tsam, the length at which the n-th light emission signal EM(n) rises may be shortened. Accordingly, the internal compensation time may be longer.

In addition, at the end timing of the sampling period Tsam, the falling length of the n-th light emission signal EM(n) may be shortened. Accordingly, the input time of the data voltage Vdata, which is the image signal, is increased, and thus the compensation rate may be increased.

Accordingly, the on-off operation timing of the (n+1)-th second scan signal SCAN2(*n*+1) and the n-th light emission signal EM(n) in the sampling period Tsam are synchronized with each other, so that the compensation rate may be improved.

Figure 13:
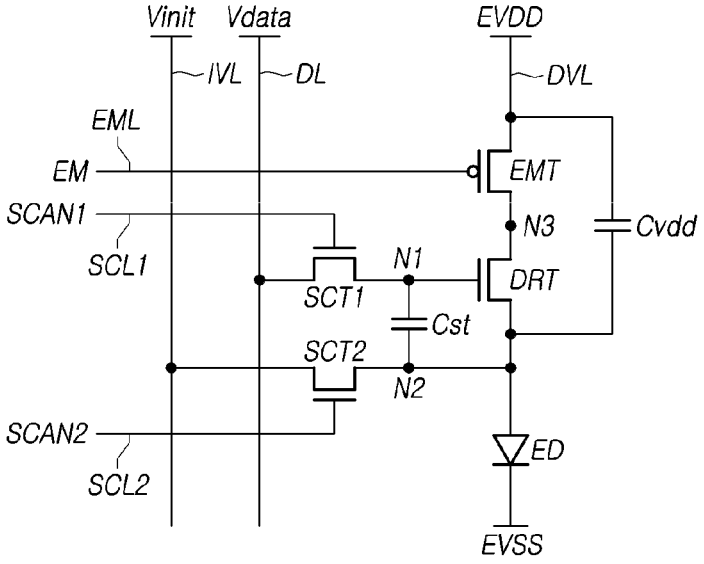
FIG. 13 illustrates another compensation circuit modified from the compensation circuit of FIG. 4.
Figure 14:
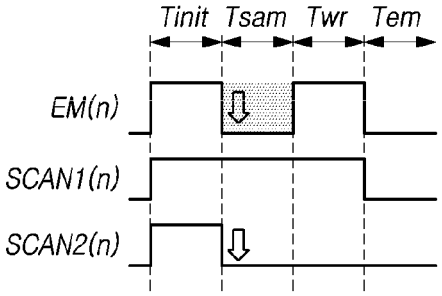
FIG. 14 is a driving timing diagram of the compensation circuit of FIG. 13.
Figure 15:
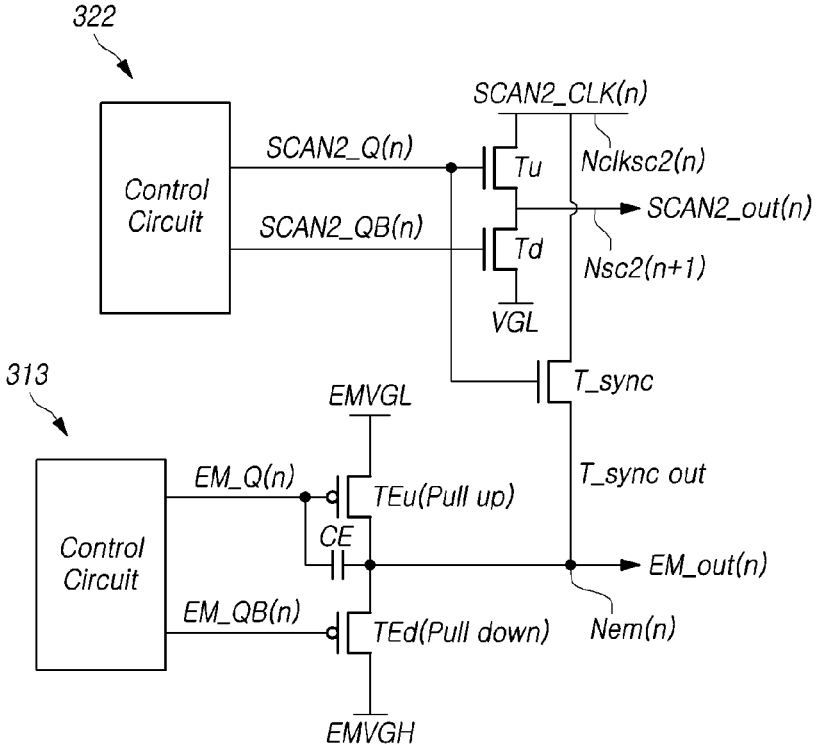
FIG. 15 illustrates a gate driving circuit for the compensation circuit of FIG. 13.

FIG. 13 illustrates another compensation circuit modified from the compensation circuit of FIG. 4, FIG. 14 is a driving timing diagram of the compensation circuit of FIG. 13, and FIG. 15 illustrates a gate driving circuit for the compensation circuit of FIG. 13.

In the compensation circuit of FIG. 13, the first scan transistor SCT1, the second scan transistor SCT2 are N-type transistors, and the light emitting transistor EMT is a P-type transistors. Only in this respect, the compensation circuit of FIG. 13 is different from the compensation circuit of FIG. 4 and the rest of the configuration is the same.

Referring to FIG. 13, since the first scan transistor SCT1 and the second scan transistor SCT2 are N-type transistors, a turn-on level voltage of each of the first scan transistor SCT1 and the second scan transistor SCT2 is a high-level voltage, and a turn-off level voltage of each of the first scan transistor SCT1 and the second scan transistor SCT2 is a low-level voltage.

Since the light emitting transistor EMT is a P-type transistor, a turn-on level voltage of the light emitting transistor EMT is a low-level voltage, and a turn-off level voltage of the light emitting transistor EMT is a high-level voltage.

Accordingly, in the driving timing diagram of the compensation circuit of FIG. 13 shown in FIG. 14, only for the n-th light emission signal EM(n), the voltage level is changed to match the P-type transistor, and the driving timing diagram of the compensation circuit of FIG. 13 is the same as the driving timing diagram of the compensation circuit of FIG. 4 shown in FIG. 5.

Referring to FIG. 14, during a period in which the n-th subpixel SP(n) included in the n-th subpixel row SPR(n) is driven, the n-th light emission signal EM(n) may include a first high-level voltage section, a first low-level voltage section, a second high-level voltage section, and a second low-level voltage section.

During the driving period of the n-th subpixel SP(n) included in the n-th subpixel row SPR(n), in the n-th light emission signal EM(n), the first high-level voltage section may correspond to an initialization period Tinit, the first low-level voltage section may correspond to a sampling period Tsam, the second high-level voltage section may correspond to a writing period Twr, and the second low-level voltage section may correspond to a light emission period Tem.

During a period in which the n-th subpixel SP(n) included in the n-th subpixel row SPR(n) is driven, in the n-th light emission signal EM(n), the falling timing at which the first high-level voltage section is changed to the first low-level voltage section may be synchronized with the falling timing of the m-th second scan signal SCAN2(*m*).

In the synchronization method applied to the compensation circuit of FIG. 13, m is n. Accordingly, during the driving period of the n-th subpixel SP(n) included in the n-th subpixel row SPR(n), in the n-th light emission signal EM(n), the falling timing at which the first high-level voltage section is changed to the first low-level voltage section may be synchronized with the falling timing of the n-th second scan signal SCAN2(*n*). Here, the falling timing of the n-th second scan signal SCAN2(*n*) is a timing of falling from a high-level voltage that is a turn-on level voltage of the n-th second scan signal SCAN2(*n*) to a low-level voltage that is a turn-off level voltage.

Referring to FIG. 15, the gate driving circuit 130 may include a n-th light emitting driver 313 and a (n+1)-th second scan driver 322 for the compensation circuit of FIG. 13.

The pull-up transistor TEu and the pull-down transistor TEd included in the n-th light emitting driver 313 are P-type transistors. The pull-up transistor Tu and the pull-down transistor Td included in the (n+1)-th second scan driver 322 are N-type transistors.

Accordingly, in the case that the types of the pull-up transistor TEu and the pull-down transistor TEd included in the n-th light emitting driver 313 are different from the types of the pull-up transistor Tu and the pull-down transistor Td included in the (n+1)-th second scan driver 322, during a period in which the n-th subpixel SP(n) included in the n-th subpixel row SPR(n) is driven, in the n-th light emission signal EM(n), the rising timing at which the first low-level voltage section is changed to the second high-level voltage section is not synchronized with the rising timing of the (n+1)-th second scan signal SCAN2(*n*+1).

Referring to FIGS. 13 and 15, in the case that the first scan transistor SCT1 and the second scan transistor SCT2 are N-transistors in the compensation circuit as the equivalent circuit of the n-th subpixel SP(n), the (n+1)-th second scan driver 322 may include a pull-up transistor Tu and a pull-down transistor Td that are N-type transistors.

In the case that the light emitting transistor EMT is a P-type transistor in the compensation circuit as the equivalent circuit of the n-th subpixel SP(n), the n-th light emitting driver 313 may include a pull-up transistor TEu and a pull-down transistor TEd that are P-type transistors.

Referring to FIG. 15, in the (n+1)-th second scan driver 322, the pull-up transistor Tu is controlled to be turned on/off by the voltage of the Q node SCAN2_Q(n+1), and controls the connection between the clock input terminal Nclksc2(*n*+1) and the (n+1)-th second scan output terminal Nsc2(*n*+1). The pull-down transistor Td is controlled to be turned on/off by the voltage of the QB node SCAN2_QB (n+1), and controls the connection between a node to which the low-level gate voltage VGL is applied and the (n+1)-th second scan output terminals Nsc2(*n*+1).

In the n-th light emitting driver 313, the pull-up transistor TEu is controlled to be turned on/off by the voltage of the Q node EM_Q(n), and controls the connection between a node to which the low-level gate voltage EMVGL is applied and the n-th light emission output terminal Nem(n). The pull-down transistor TEd is controlled to be turned on/off by the voltage of the QB node EM_QB(n), and controls the connection between the node to which the high-level gate voltage EMVGH is applied and the n-th light emission output terminal Nem(n).

As described above, during the sampling period Tsam in the period in which the n-th subpixel SP(n) included in the n-th subpixel row SPR(n) is driven, the synchronization between the falling timing of the n-th light emission signal EM(n) and the falling timing of the (n+1)-th second scan signal SCAN2(*n*+1) may be enabled by a synchronization transistor T_sync.

The synchronization transistor T_sync may be controlled according to the voltage of the Q node SCAN2_Q(n+1) of the (n+1)-th second scan driver 322, and may control an electrical connection between the light emission output terminal Nem(n) of the n-th light emitting driver 313 and the clock input terminal Nclksc2(*n*+1) of the (n+1)-th second scan driver 322. Here, the synchronization transistor T_sync may be included in the gate driving circuit 130 or included in the display panel 110.

The operation method of the synchronization transistor T_sync that enables synchronization between the n-th light emission signal EM(n) and the (n+1)-th second scan signal SCAN2(*n*+1) is the same as the method described above with reference to FIG. 9 except that the transistor type and various voltage levels changed accordingly.

Referring to FIG. 15, the synchronization transistor T_sync may be a N-type transistor. The type of the synchronization transistor T_sync may be the same as that of each of the first scan transistor SCT1 and the second scan transistor SCT2 as a N-type. The type of the synchronization transistor T_sync is the same as that of each of the pull-up transistor Tu and the pull-down transistor Td included in the (n+1)-th second scan driver 322 as a N-type.

According to the above-described operation using the synchronization transistor T_sync, during a period in which the n-th subpixel SP(n) included in the n-th subpixel row SPR(n) is driven, in the n-th light emission signal EM(n), the falling timing at which the first high-level voltage section is changed to the first low-level voltage section may be synchronized with the falling timing of the (n+1)-th second scan signal SCAN2(*n*+1).

Accordingly, at a start timing of the sampling period Tsam, the length at which the n-th light emission signal EM(n) falls may be shortened. Accordingly, the internal compensation time may be longer.

Figure 16:
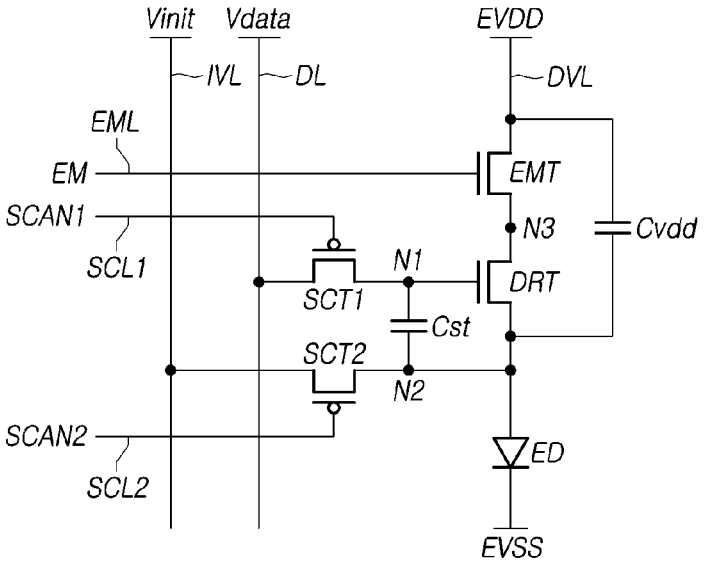
FIG. 16 illustrates another compensation circuit modified from the compensation circuit of FIG. 4.
Figure 17:
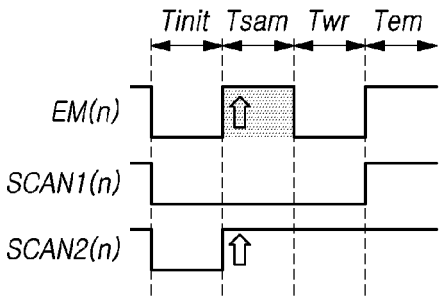
FIG. 17 is a driving timing diagram of the compensation circuit of FIG. 16.
Figure 18:
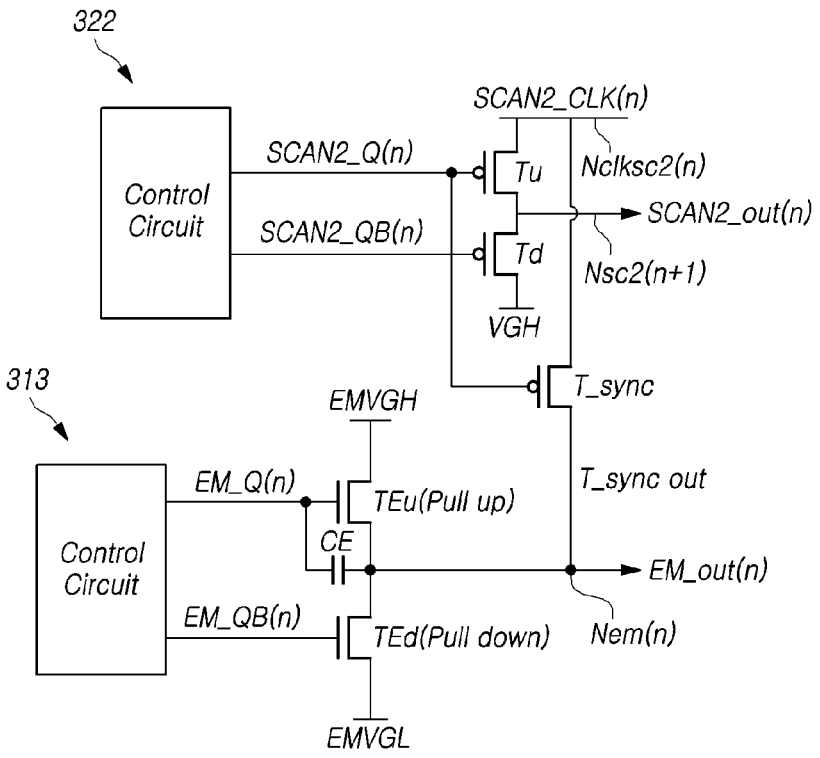
FIG. 18 illustrates a gate driving circuit for the compensation circuit of FIG. 16.

FIG. 16 illustrates another compensation circuit modified from the compensation circuit of FIG. 4, FIG. 17 is a driving timing diagram of the compensation circuit of FIG. 16, and FIG. 18 illustrates a gate driving circuit 130 for the compensation circuit of FIG. 16.

In the compensation circuit of FIG. 16, the first scan transistor SCT1, the second scan transistor SCT2 are P-type transistors, and the light emitting transistor EMT is a N-type transistors. Only in this respect, the compensation circuit of FIG. 16 is different from the compensation circuit of FIG. 4 and the rest of the configuration is the same.

Referring to FIG. 16, since the first scan transistor SCT1 and the second scan transistor SCT2 are P-type transistors, a turn-on level voltage of each of the first scan transistor SCT1 and the second scan transistor SCT2 is a low-level voltage, and a turn-off level voltage of each of the first scan transistor SCT1 and the second scan transistor SCT2 is a high-level voltage.

Since the light emitting transistor EMT is a N-type transistor, a turn-on level voltage of the light emitting transistor EMT is a high-level voltage, and a turn-off level voltage of the light emitting transistor EMT is a low-level voltage.

Accordingly, in the driving timing diagram of the compensation circuit of FIG. 16 shown in FIG. 17, only for the n-th first scan signal SCAN1(*n*) and the n-th second scan signal SCAN2(*n*), the voltage level is changed to match the P-type transistor, and the driving timing diagram of the compensation circuit of FIG. 16 is the same as the driving timing diagram of the compensation circuit of FIG. 4 shown in FIG. 5.

Referring to FIG. 17, during a period in which the n-th subpixel SP(n) included in the n-th subpixel row SPR(n) is driven, the n-th light emission signal EM(n) may include a first low-level voltage section, a first high-level voltage section, a second low-level voltage section, and a second high-level voltage section.

During the driving period of the n-th subpixel SP(n) included in the n-th subpixel row SPR(n), in the n-th light emission signal EM(n), the first low-level voltage section may correspond to an initialization period Tinit, the first high-level voltage section may correspond to a sampling period Tsam, the second low-level voltage section may correspond to a writing period Twr, and the second high-level voltage section may correspond to a light emission period Tem.

During a period in which the n-th subpixel SP(n) included in the n-th subpixel row SPR(n) is driven, in the n-th light emission signal EM(n), the rising timing at which the first low-level voltage section is changed to the first high-level voltage section may be synchronized with the rising timing of the m-th second scan signal SCAN2(*m*).

In the synchronization method applied to the compensation circuit of FIG. 16, m is n. Accordingly, during the driving period of the n-th subpixel SP(n) included in the n-th subpixel row SPR(n), in the n-th light emission signal EM(n), the rising timing at which the first low-level voltage section is changed to the first high-level voltage section may be synchronized with the rising timing of the n-th second scan signal SCAN2(*n*). Here, the rising timing of the n-th second scan signal SCAN2(*n*) is a timing of rising from a low-level voltage as a turn-on level voltage of the n-th second scan signal SCAN2(*n*) to a high-level voltage as a turn-off level voltage.

Referring to FIG. 18, the gate driving circuit 130 may include a n-th light emitting driver 313 and a (n+1)-th second scan driver 322 for the compensation circuit of FIG. 16.

The pull-up transistor TEu and the pull-down transistor TEd included in the n-th light emitting driver 313 are N-type transistors. The pull-up transistor Tu and the pull-down transistor Td included in the (n+1)-th second scan driver 322 are P-type transistors.

Accordingly, in the case that the types of the pull-up transistor TEu and the pull-down transistor TEd included in the n-th light emitting driver 313 are different from the types of the pull-up transistor Tu and the pull-down transistor Td included in the (n+1)-th second scan driver 322, during a period in which the n-th subpixel SP(n) included in the n-th subpixel row SPR(n) is driven, in the n-th light emission signal EM(n), the falling timing at which the first high-level voltage section is changed to the second low-level voltage section is not synchronized with the falling timing of the (n+1)-th second scan signal SCAN2(*n*+1).

Referring to FIGS. 16 and 18, in the case that the first scan transistor SCT1 and the second scan transistor SCT2 are P-transistors in the compensation circuit as the equivalent circuit of the n-th subpixel SP(n), the (n+1)-th second scan driver 322 may include a pull-up transistor Tu and a pull-down transistor Td that are P-type transistors.

In the case that the light emitting transistor EMT is a N-type transistor in the compensation circuit as the equivalent circuit of the n-th subpixel SP(n), the n-th light emitting driver 313 may include a pull-up transistor TEu and a pull-down transistor Ted that are N-type transistors.

Referring to FIG. 18, in the (n+1)-th second scan driver 322, the pull-up transistor Tu is controlled to be turned on/off by the voltage of the Q node SCAN2_Q(n+1), and controls the connection between the clock input terminal Nclksc2(*n*+1) and the (n+1)-th second scan output terminal Nsc2(*n*+1). The pull-down transistor Td is controlled to be turned on/off by the voltage of the QB node SCAN2_QB (n+1), and controls the connection between a node to which the high-level gate voltage VGH is applied and the (n+1)-th second scan output terminals Nsc2(*n*+1).

In the n-th light emitting driver 313, the pull-up transistor TEu is controlled to be turned on/off by the voltage of the Q node EM_Q(n), and controls the connection between a node to which the high-level gate voltage EMVGH is applied and the n-th light emission output terminal Nem(n). The pull-down transistor TEd is controlled to be turned on/off by the voltage of the QB node EM_QB(n), and controls the connection between the node to which the low-level gate voltage EMVGL is applied and the n-th light emission output terminal Nem(n).

As described above, during the sampling period Tsam in the period in which the n-th subpixel SP(n) included in the n-th subpixel row SPR(n) is driven, the synchronization between the rising timing of the n-th light emission signal EM(n) and the rising timing of the (n+1)-th second scan signal SCAN2(*n*+1) may be enabled by a synchronization transistor T_sync.

The synchronization transistor T_sync may be controlled according to the voltage of the Q node SCAN2_Q(n+1) of the (n+1)-th second scan driver 322, and may control an electrical connection between the light emission output terminal Nem(n) of the n-th light emitting driver 313 and the clock input terminal Nclksc2(*n*+1) of the (n+1)-th second scan driver 322. Here, the synchronization transistor T_sync may be included in the gate driving circuit 130 or included in the display panel 110.

The operation method of the synchronization transistor T_sync that enables synchronization between the n-th light emission signal EM(n) and the (n+1)-th second scan signal SCAN2(*n*+1) is the same as the method described above with reference to FIG. 9 except that the transistor type and various voltage levels changed accordingly.

Referring to FIG. 18, the synchronization transistor T_sync may be a P-type transistor. The type of the synchronization transistor T_sync may be the same as that of each of the first scan transistor SCT1 and the second scan transistor SCT2 as a P-type. The type of the synchronization transistor T_sync is the same as that of each of the pull-up transistor Tu and the pull-down transistor Td included in the (n+1)-th second scan driver 322 as a P-type.

According to the above-described operation using the synchronization transistor T_sync, during a period in which the n-th subpixel SP(n) included in the n-th subpixel row SPR(n) is driven, in the n-th light emission signal EM(n), the rising timing at which the first low-level voltage section is changed to the first high-level voltage section may be synchronized with the rising timing of the (n+1)-th second scan signal SCAN2(*n*+1).

Accordingly, at a start timing of the sampling period Tsam, the length at which the n-th light emission signal EM(n) rises may be shortened. Accordingly, the internal compensation time may be longer, thereby improving the compensation rate.

As described above, the timing at which the n-th light emission signal EM(n) rises from the low-level voltage to the high-level voltage EMVGH may be synchronized with the timing of rising from the low-level voltage to the high-level voltage of the (n+1)-th second scan signal SCAN2(*n*+1).

At this time, in the (n+1)-th second scan driver 322, the Q node SCAN2_Q(n+1) is boosted with a high voltage, so the synchronization transistor T_sync may be completely turned on, thereby greatly improving the rising characteristic of the n-th light emission signal EM(n).

Figure 19A:
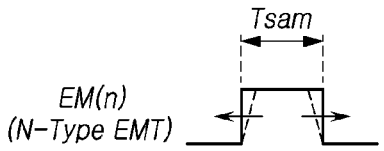
FIGS. 19A and 19B illustrate a light emission signal having improved rising characteristics and falling characteristics by using a synchronization transistor in a display device according to embodiments of the present disclosure.
Figure 19B:
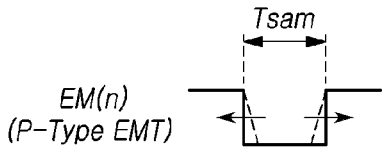

FIGS. 19A and 19B illustrate a light emission signal EM(n) having improved rising characteristics and falling characteristics by using a synchronization transistor T_sync in a display device 100 according to embodiments of the present disclosure.

FIG. 19A illustrates the n-th light emission signal EM(n) applied to a gate node of a N-type light emitting transistor EMT during a sampling period Tsam within the period in which the n-th subpixel SP(n) is driven.

FIG. 19B illustrates the n-th light emission signal EM(n) applied to a gate node of a P-type light emitting transistor EMT during a sampling period Tsam within the period in which the n-th subpixel SP(n) is driven.

Referring to FIGS. 19A and 19B, using the synchronization transistor T_sync, the rising timing and/or the falling timing of the n-th light emission signal EM(n) may be synchronized with the rising timing and/or the falling timing of the m-th second scan signal SCAN2(*m*), so that the rising length and/or the falling length of the n-th light emission signal EM(n) may be reduced.

Accordingly, at the start timing of the sampling period Tsam, the rising length or the falling length of the n-th light emission signal EM(n) may be shortened. Accordingly, the internal compensation time may be extended.

In addition, at the end timing of the sampling period Tsam, the falling length or the rising length of the n-th light emission signal EM(n) may be shortened. Accordingly, the input time of the data voltage Vdata as the image signal may be increased, and thus the compensation rate may be increased.

As such, the on-off timing of the (n+1)-th second scan signal SCAN2(*n*+1) and the n-th light emission signal EM(n) in the sampling period Tsam are synchronized with each other, thereby improving the compensation rate.

Figure 20:
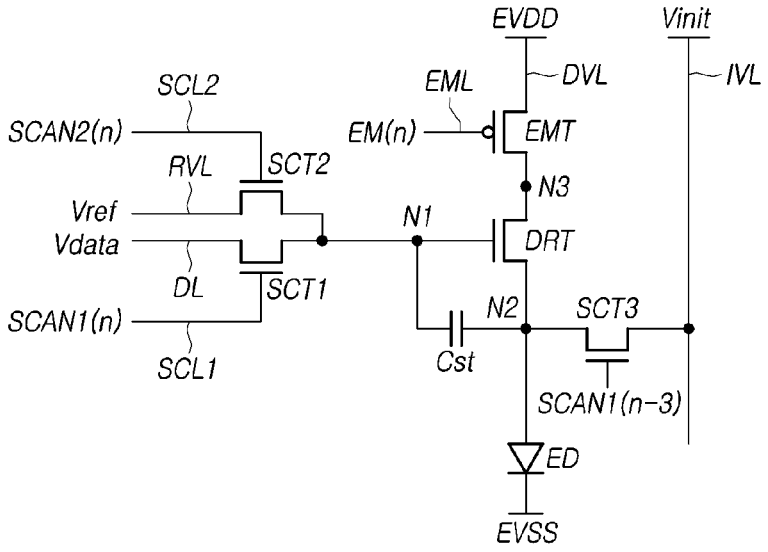
FIG. 20 illustrates another compensation circuit modified from the compensation circuit of FIG. 4.
Figure 21:
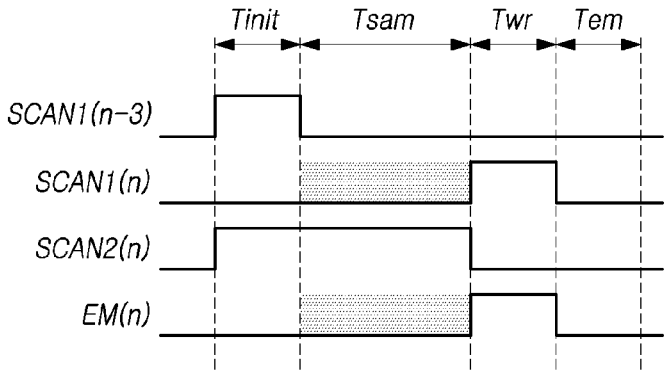
FIG. 21 is a driving timing diagram of the compensation circuit of FIG. 20.

FIG. 20 illustrates another compensation circuit modified from the compensation circuit of FIG. 4, and FIG. 21 is a driving timing diagram of the compensation circuit of FIG. 20.

Referring to FIG. 20, the n-th subpixel SP(n) included in the n-th subpixel row SPR(n) may include a light emitting device ED, a driving transistor DRT for driving the light emitting device ED, a first scan transistor SCT1 controlled by the n-th first scan signal SCAN1(*n*) and controlling an electrical connection between a first node N1 of the driving transistor DRT and a data line DL, a second scan transistor SCT2 controlled by the n-th second scan signal SCAN2(*n*) and controlling an electrical connection between the first node N1 of the driving transistor DRT and a reference line RVL supplying a reference voltage Vref, a third scan transistor SCT3 controlled by the m-th first scan signal SCAN1(*m*) and controlling an electrical connection between a second node N2 of the driving transistor DRT and an initialization line IVL, a light emitting transistor EMT controlled by the n-th light emission signal EM(n) and controlling an electrical connection between a third node N3 of the driving transistor DRT and a driving line DVL, and a storage capacitor Cst electrically connected between the first node N1 and the second node N2 of the driving transistor DRT.

The light emitting transistor EMT may be a P-type transistor, and each of the first scan transistor SCT1, the second scan transistor SCT2 and the third scan transistor SCT3 may be a N-type transistor.

Since the light emitting transistor EMT is a P-type transistor, the turn-on level voltage of the light emitting transistor EMT is a low-level voltage, and the turn-off level voltage of the light emitting transistor EMT is a high-level voltage.

Since the first scan transistor SCT1, the second scan transistor SCT2 and the third scan transistor SCT3 are N-type transistors, the turn-on level voltage of each of the first scan transistor SCT1, the second scan transistor SCT2 and the third scan transistors SCT3 is a high-level voltage, and the turn-off level voltage of each of the first scan transistor SCT1, the second scan transistor SCT2 and the third scan transistor SCT3 is a low-level voltage.

Referring to FIG. 21, during a period in which the n-th subpixel SP(n) included in the n-th subpixel row SPR(n) is driven, the rising timing of the n-th light emission signal EM(n) may be synchronized with the rising timing of the n-th first scan signal SCAN1(*n*).

Accordingly, at the end timing of the sampling period Tsam, the falling length of the n-th light emission signal EM(n) may be shortened. Accordingly, the input time of the data voltage Vdata, which is the image signal, may be increased, and thus the compensation rate may be increased.

According to the embodiments of the present disclosure described above, it is possible to accurately perform internal compensation without being affected by deterioration or deviation of the on-off performance of the light emitting transistor controlling the light emission or the light emission timing. As a result, it is possible to provide the display device 100 and the gate driving circuit 130 capable of improving the image quality.

According to embodiments of the present disclosure, it is possible to provide a display device 100 and a gate driving circuit 130 capable of improving the rising characteristic and/or the falling characteristic of a light emission signal EM which is a type of a gate signal, thereby improving the threshold voltage compensation performance of the driving transistor DRT to improve the image quality.

According to embodiments of the present disclosure, it is possible to provide a display device 100 and a gate driving circuit 130 capable of improving the rising characteristic and/or the falling characteristic of a light emission signal EM which is a type of a gate signal, thereby increasing the data input time and improving the charging performance of the subpixel SP to improve the image quality.

Some embodiments of the present disclosure includes a display device having a display panel including a plurality of data lines, a plurality of first scan lines, a plurality of second scan lines, a plurality of light emission lines, and a plurality of subpixels. The display device also includes a data driving circuit for outputting data voltages to the plurality of data lines and a gate driving circuit for outputting first scan signals to the plurality of first scan lines, outputting second scan signals to the plurality of second scan lines, and outputting light emission signals to the plurality of light emission lines.

For example, each of the plurality of subpixels includes a light emitting device, a driving transistor for driving the light emitting device, a first scan transistor controlled by a first scan signal and configured to control an electrical connection between a first node of the driving transistor and a data line, a second scan transistor controlled by a second scan signal and configured to control an electrical connection between a second node of the driving transistor and an initialization line, a light emitting transistor controlled by the light emission signal and configured to control an electrical connection between a third node of the driving transistor and a driving line, and a storage capacitor connected between the first node and the second node of the driving transistor.

The plurality of subpixels constitutes a plurality of subpixel rows, and the plurality of subpixel rows includes a n-th subpixel row.

The plurality of first scan lines includes a n-th first scan line corresponding to the n-th subpixel row and a m-th first scan line corresponding to a m-th subpixel row which is identical to or different from the n-th subpixel row, and the plurality of second scan lines include a n-th second scan line corresponding to the n-th subpixel row and a m-th second scan line corresponding to the m-th subpixel row, and the plurality of the light emission lines includes a n-th light emission line corresponding to the n-th subpixel row and n m-th light emission line corresponding to the m-th subpixel row.

During a period in which a n-th subpixel included in the n-th subpixel row is driven, a n-th light emission signal includes a first turn-off level voltage section, a first turn-on level voltage section, a second turn-off level voltage section and a second turn-on level voltage section, and, in the n-th light emission signal, a rising timing or a falling timing at which the first turn-off level voltage section is changed to the first turn-on level voltage section is synchronized with a rising timing or a falling timing of a m-th second scan signal.

The display device according to some embodiments of the present disclosure includes the gate driving circuit having a n-th gate driving circuit, a m-th gate driving circuit, and a synchronization transistor.

The n-th gate driving circuit includes a n-th first scan driver for outputting a n-th first scan signal to the n-th first scan line, and a n-th second scan driver for outputting a n-th second scan signal to the n-th second scan line, and a n-th light emitting driver for outputting a n-th light emission signal to the n-th light emission line.

The m-th gate driving circuit includes a m-th first scan driver for outputting a m-th first scan signal to the m-th first scan line, a m-th second scan driver for outputting a m-th second scan signal to the m-th second scan line, and a m-th light emitting driver for outputting a m-th light emission signal to the m-th light emission line.

The synchronization transistor is controlled based on a voltage of a Q node of the m-th second scan driver and controlling an electrical connection between an output terminal of the n-th light emitting driver and a clock input terminal of the m-th second scan driver.

In some embodiments, a type of the synchronization transistor is the same as a type of each of the first scan transistor and the second scan transistor.

The above description has been presented to enable any person skilled in the art to make and use the technical idea of the present disclosure, and has been provided in the context of a particular application and its requirements. Various modifications, additions and substitutions to the described embodiments will be readily apparent to those skilled in the art, and the general principles defined herein may be applied to other embodiments and applications without departing from the spirit and scope of the present disclosure. The above description and the accompanying drawings provide an example of the technical idea of the present disclosure for illustrative purposes only. That is, the disclosed embodiments are intended to illustrate the scope of the technical idea of the present disclosure. Thus, the scope of the present disclosure is not limited to the embodiments shown, but is to be accorded the widest scope consistent with the claims. The scope of protection of the present disclosure should be construed based on all technical ideas within the scope of equivalents thereof should be construed as being included within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device comprising:

a display panel including a plurality of data lines, a plurality of first scan lines, a plurality of second scan lines, a plurality of light emission lines, and a plurality of subpixels;

a data driving circuit for outputting data voltages to the plurality of data lines;

a gate driving circuit for outputting first scan signals to the plurality of first scan lines, outputting second scan signals to the plurality of second scan lines, and outputting light emission signals to the plurality of light emission lines, wherein the plurality of subpixels includes a plurality of subpixel rows, and the plurality of subpixel rows includes a n-th subpixel row, wherein the plurality of first scan lines includes a n-th first scan line corresponding to the n-th subpixel row and a m-th first scan line corresponding to a m-th subpixel row, and the plurality of second scan lines include a n-th second scan line corresponding to the n-th subpixel row and a m-th second scan line corresponding to the m-th subpixel row, and the plurality of the light emission lines includes a n-th light emission line corresponding to the n-th subpixel row and m-th light emission line corresponding to the m-th subpixel row, wherein n is a natural number and m is a natural number that is either equal to or different from n, wherein the gate driving circuit includes:

a n-th gate driving circuit including a n-th first scan driver for outputting a n-th first scan signal to the n-th first scan line, a n-th second scan driver for outputting a n-th second scan signal to the n-th second scan line, and a n-th light emitting driver for outputting a n-th light emission signal to the n-th light emission line;

a m-th gate driving circuit including a m-th first scan driver for outputting a m-th first scan signal to the m-th first scan line, a m-th second scan driver for outputting a m-th second scan signal to the m-th second scan line, and a m-th light emitting driver for outputting a m-th light emission signal to the m-th light emission line; and a synchronization transistor controlled based on a voltage of a gate node of the m-th second scan driver and controlling an electrical connection between an output terminal of the n-th light emitting driver and a clock input terminal of the m-th second scan driver.

2. The display device of claim 1, wherein, during a period in which a n-th subpixel included in the n-th subpixel row is driven, the n-th light emission signal includes a first turn-off level voltage section, a first turn-on level voltage section, a second turn-off level voltage section, and a second turn-on level voltage section, and, in the n-th light emission signal, a rising timing or a falling timing at which the first turn-off level voltage section is changed to the first turn-on level voltage section is synchronized with a rising timing or a falling timing of the m-th second scan signal.

3. The display device of claim 2, wherein the n-th light emitting driver includes a pull-up transistor and a pull-down transistor, and the m-th second scan driver includes a pull-up transistor and a pull-down transistor, wherein, in the case that a type of each of the pull-up transistor and the pull-down transistor included in the n-th light emitting driver is the same as a type of each of the pull-up transistor and pull-down transistor included in the m-th second scan driver, during a period in which the n-th subpixel included in the n-th subpixel row is driven, in the n-th light emission signal, a falling timing or a rising timing at which the first turn-on level voltage section is changed to the second turn-off level voltage section is synchronized with a falling timing or a rising timing of the m-th second scan signal.

4. The display device of claim 2, wherein the n-th light emitting driver includes a pull-up transistor and a pull-down transistor, and the m-th second scan driver includes a pull-up transistor and a pull-down transistor, wherein, in the case that a type of each of the pull-up transistor and the pull-down transistor included in the n-th light emitting driver is different from a type of each of the pull-up transistor and pull-down transistor included in the m-th second scan driver, during a period in which the n-th subpixel included in the n-th subpixel row is driven, in the n-th light emission signal, a falling timing or a rising timing at which the first turn-on level voltage section is changed to the second turn-off level voltage section is not synchronized with a falling timing or a rising timing of the m-th second scan signal.

5. The display device of claim 1, wherein a n-th subpixel included in the n-th subpixel row comprises:

a light emitting device;

a driving transistor for driving the light emitting device;

a first scan transistor controlled by the n-th first scan signal and configured to control an electrical connection between a first node of the driving transistor and a data line;

a second scan transistor controlled by the n-th second scan signal and configured to control an electrical connection between a second node of the driving transistor and an initialization line;

a light emitting transistor controlled by the n-th light emission signal and configured to control an electrical connection between a third node of the driving transistor and a driving line; and a storage capacitor between the first node and the second node of the driving transistor, wherein, during a period in which the n-th subpixel included in the n-th subpixel row is driven, the n-th light emission signal includes a first turn-off level voltage section, a first turn-on level voltage section, a second turn-off level voltage section, and a second turn-on level voltage section, and, in the n-th light emission signal, a rising timing or a falling timing at which the first turn-off level voltage section is changed to the first turn-on level voltage section is synchronized with a rising timing or a falling timing of the m-th second scan signal.

6. The display device of claim 5, wherein a type of the synchronization transistor is the same as a type of each of the first scan transistor and the second scan transistor.

7. The display device of claim 5, wherein the n-th light emitting driver includes a pull-up transistor and a pull-down transistor, and the m-th second scan driver includes a pull-up transistor and a pull-down transistor, wherein a type of the synchronization transistor is the same as a type of each of the pull-up transistor and the pull-down transistor included in the m-th second scan driver.

8. The display device of claim 5, wherein, in the case that the first scan transistor, the second scan transistor and the light emitting transistor are N-type transistors, the n-th light emitting driver includes a pull-up transistor and a pull-down transistor which are N-type transistors, and the m-th second scan driver includes a pull-up transistor and a pull-down transistor which are N-type transistors, and the synchronization transistor is a N-type transistor.

9. The display device of claim 8, wherein m is (n+1), and, during the period in which the n-th subpixel included in the n-th subpixel row is driven, in the n-th light emission signal, a rising timing at which the first turn-off level voltage section is changed to the first turn-on level voltage section is synchronized with a rising timing of a (n+1)-th second scan signal, and, in the n-th light emission signal, a falling timing at which the first turn-on level voltage section is changed to the second turn-off level voltage section is synchronized with a falling timing of the (n+1)-th second scan signal.

10. The display device of claim 5, wherein, in the case that the first scan transistor, the second scan transistor and the light emitting transistor are P-type transistors, the n-th light emitting driver includes a pull-up transistor and a pull-down transistor which are P-type transistors, and the m-th second scan driver includes a pull-up transistor and a pull-down transistor which are P-type transistors, and the synchronization transistor is a P-type transistor.

11. The display device of claim 10, wherein m is (n+1), and, during the period in which the n-th subpixel included in the n-th subpixel row is driven, in the n-th light emission signal, a falling timing at which the first turn-off level voltage section is changed to the first turn-on level voltage section is synchronized with a falling timing of a (n+1)-th second scan signal, and, in the n-th light emission signal, a rising timing at which the first turn-on level voltage section is changed to the second turn-off level voltage section is synchronized with a rising timing of the (n+1)-th second scan signal.

12. The display device of claim 5, wherein, in the case that the first scan transistor and the second scan transistor are N-type transistors and the light emitting transistor is a P-type transistor, the n-th light emitting driver includes a pull-up transistor and a pull-down transistor which are P-type transistors, and the m-th second scan driver includes a pull-up transistor and a pull-down transistor which are N-type transistors, and the synchronization transistor is a N-type transistor.

13. The display device of claim 12, wherein the m is the n, and, during the period in which the n-th subpixel included in the n-th subpixel row is driven, in the n-th light emission signal, a falling timing at which the first turn-off level voltage section is changed to the first turn-on level voltage section is synchronized with a falling timing of the n-th second scan signal, and, in the n-th light emission signal, a rising timing at which the first turn-on level voltage section is changed to the second turn-off level voltage section is not synchronized with a rising timing of the n-th second scan signal.

14. The display device of claim 5, wherein, in the case that the first scan transistor and the second scan transistor are P-type transistors and the light emitting transistor is a N-type transistor, the n-th light emitting driver includes a pull-up transistor and a pull-down transistor which are N-type transistors, and the m-th second scan driver includes a pull-up transistor and a pull-down transistor which are P-type transistors, and the synchronization transistor is a P-type transistor.

15. The display device of claim 14, wherein the m is the n, and, during the period in which the n-th subpixel included in the n-th subpixel row is driven, in the n-th light emission signal, a rising timing at which the first turn-off level voltage section is changed to the first turn-on level voltage section is synchronized with a rising timing of the n-th second scan signal, and, in the n-th light emission signal, a falling timing at which the first turn-on level voltage section is changed to the second turn-off level voltage section is not synchronized with a falling timing of the n-th second scan signal.

16. The display device of claim 5, wherein, during a period in which the n-th light emission signal is the first turn-on level voltage section within the period in which the n-th subpixel included in the n-th subpixel row is driven, a voltage of the second node of the driving transistor is boosted, and a voltage difference between the first node and the second node of the driving transistor becomes a threshold voltage of the driving transistor.

17. A gate driving circuit comprising:

a n-th light emitting driver for outputting a n-th light emission signal to a n-th light emission line arranged in a n-th subpixel row, wherein n is a natural number;

a m-th scan driver for outputting a m-th scan signal to a m-th scan line arranged in a m-th subpixel row which is either the same as or different from the n-th subpixel row, wherein m is a natural number; and a synchronization transistor controlled based on a voltage of a Q node of the m-th scan driver and controlling an electrical connection between an output terminal of the n-th light emitting driver and a clock input terminal of the m-th scan driver.

18. A device comprising:

a first subpixel, the first subpixel including:

a driving transistor having a first node, a second node, and a third node;

a light emitting diode coupled to the second node of the driving transistor;

a first transistor configured to provide a data signal from a data line to the first node of the driving transistor based on a first scan signal from a first scan line;

a second transistor configured to provide an initialization voltage from an initialization line to the second node of the driving transistor based on a second scan signal from a second scan line;

a third transistor coupled to the third node of the driving transistor, the third transistor configured to provide a driving voltage to the third node of the driving transistor based on a light emission signal from an emission line;

a first capacitor coupled between the first node and the second node of the driving transistor;

a second capacitor coupled the second node of the driving transistor and a driving line;

a first gate driving circuit, the first gate driving circuit including:

a light emitting driver for outputting the light emission signal to the light emission line;

a first scan driver for outputting the first scan signal to the first scan line; and a second scan driver for outputting the second scan signal to the second scan line; and a second subpixel, the second subpixel including:

a second driving transistor having a first node, a second node, and a third node;

a second light emitting diode coupled to the second node of the second driving transistor;

a fourth transistor configured to provide a data signal from a data line to the first node of the second driving transistor based on a third scan signal to a third scan line; and a fifth transistor configured to provide an initialization voltage from an initialization line to the second node of the second driving transistor based on a fourth scan signal to a fourth scan line, wherein the second subpixel is coupled to a second gate driving circuit, the second gate driving circuit includes:

a third scan driver for outputting the third scan signal to the third scan line; and a fourth scan driver for outputting the fourth scan signal to the fourth scan line, and wherein the device further includes a synchronization transistor coupled to the light emitting driver in the first subpixel and the fourth scan driver of the second subpixel.

19. The device according to claim 18, wherein the synchronization transistor is configured to either synchronize a rising time of the light emission signal of the first subpixel with a rising time of the fourth scan signal of the second subpixel or synchronize a falling time of the light emission signal of the first subpixel with a falling time of the fourth scan signal of the second subpixel.

20. The device according to claim 18, wherein the synchronization transistor is configured to:

synchronize a rising time of the light emission signal of the first subpixel with a rising time of the fourth scan signal of the second subpixel; and synchronize a falling time of the light emission signal of the first subpixel with a falling time of the fourth scan signal of the second subpixel.

* * * * *